US011145437B2

(12) United States Patent
Kojima et al.

(10) Patent No.: US 11,145,437 B2
(45) Date of Patent: Oct. 12, 2021

(54) SHIELDED FLAT CABLE

(71) Applicant: SUMITOMO ELECTRIC INDUSTRIES, LTD., Osaka (JP)

(72) Inventors: Chiaki Kojima, Kanuma (JP); Yutaka Fukuda, Osaka (JP); Tatsuo Matsuda, Kanuma (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 92 days.

(21) Appl. No.: 16/488,713

(22) PCT Filed: Feb. 23, 2018

(86) PCT No.: PCT/JP2018/006699
§ 371 (c)(1),
(2) Date: Aug. 26, 2019

(87) PCT Pub. No.: WO2018/159489
PCT Pub. Date: Sep. 7, 2018

(65) Prior Publication Data

US 2021/0090761 A1 Mar. 25, 2021

(30) Foreign Application Priority Data

Feb. 28, 2017 (JP) ..... JP2017-035817

(51) Int. Cl.
*H01B 7/08* (2006.01)
*H01B 7/18* (2006.01)
*H01B 7/295* (2006.01)

(52) U.S. Cl.
CPC ..... *H01B 7/295* (2013.01); *H01B 7/08* (2013.01); *H01B 7/18* (2013.01)

(58) Field of Classification Search
CPC ..... H01B 13/016; H01B 7/08; H01B 7/0861; H01B 7/18; H01B 7/295; H01B 7/17
(Continued)

(56) References Cited

U.S. PATENT DOCUMENTS

2011/0232938 A1* 9/2011 Kodama ..... H01B 7/0838 174/117 F
2016/0079646 A1* 3/2016 Ichige ..... H01B 7/0861 333/238
2017/0214163 A1* 7/2017 Benedict ..... H01B 7/0838

FOREIGN PATENT DOCUMENTS

CN 101809682 A * 8/2010 ..... H01B 11/1839
CN A-101809682 8/2010
(Continued)

*Primary Examiner* — Timothy J Thompson
*Assistant Examiner* — Guillermo J Egoavil
(74) *Attorney, Agent, or Firm* — Faegre Drinker Biddle & Reath LLP

(57) ABSTRACT

A shielded flat cable includes a plurality of flat conductors arranged in parallel, a pair of resin insulating layers sandwiching the flat conductors from both sides of a parallel surface of the flat conductors, and covering portions other than end portions of the flat conductors in a length direction, a pair of shield layers in contact with an outer surface of at least one resin insulating layer of the pair of resin insulating layers, and a pair of first resin films with an adhesive covering an outer surface of the pair of resin insulating layers or the shield layer. A dielectric loss tangent of the resin insulating layer, of the pair of resin insulating layers, in contact with the shield layer is 0.001 or less at 10 GHz, and the adhesive or the pair of first resin films is made of a flame retardant material.

16 Claims, 21 Drawing Sheets

(58) Field of Classification Search
USPC ..... 174/36, 117
See application file for complete search history.

(56) References Cited

FOREIGN PATENT DOCUMENTS

| | | | | | |
|---|---|---|---|---|---|
| CN | 202076032 | U | * | 12/2011 | ..... H01B 7/08 |
| CN | U-202076032 | | | 12/2011 | |
| CN | 204288856 | U | * | 4/2015 | ..... H01B 7/08 |
| EP | A1-2202759 | | | 6/2010 | |
| JP | 2011-198687 | A | | 10/2011 | |

* cited by examiner

| | 5GHz | 6GHz | 8GHz | 10GHz |
|---|---|---|---|---|
| CABLE 1J (UNIT: dB) | -1.9 | -2.2 | -2.7 | -3.0 |
| CABLE 1Z (UNIT: dB) | -2.9 | -3.4 | -4.9 | -4.9 |
| IMPROVEMENT RATE | 34% | 36% | 45% | 39% |

SHIELDED FLAT CABLE

TECHNICAL FIELD

The present invention relates to a shielded flat cable.

The present application claims priority from Japanese Patent Application No. 2017-035817, filed on Feb. 28, 2017, the entire subject content of which is incorporated herein by reference.

BACKGROUND ART

Patent Literature 1 discloses a flat cable in which a plurality of conductors are disposed in parallel with insulating resin films bonding from above and below, and a connection terminal connected to an electrical connector is provided on at least one cable end. On the insulating resin film, a metal foil film for shielding is disposed with a metal surface thereof facing outside, and the metal foil film is covered with a protective resin film except for a ground connecting portion to be connected to ground.

CITATION LIST

Patent Literature

Patent Literature 1: JP-A-2011-198687

SUMMARY OF INVENTION

Solution to Problem

In order to achieve the above objects, the present invention provides a shielded flat cable, including:

a plurality of flat conductors arranged in parallel;

a pair of resin insulating layers sandwiching the plurality of flat conductors from both sides of a parallel surface of the plurality of flat conductors, and covering portions other than end portions of the plurality of flat conductors in a length direction;

a pair of shield layers in contact with an outer surface of at least one resin insulating layer of the pair of resin insulating layers; and a pair of first resin films with an adhesive covering an outer surface of the pair of resin insulating layers or the shield layer, wherein a dielectric loss tangent of the resin insulating layer, of the pair of resin insulating layers, in contact with the shield layer is 0.001 or less at 10 GHz, and wherein the adhesive or the pair of first resin films is made of a flame retardant material.

DESCRIPTION OF EMBODIMENTS

Technical Problem

Figure 1:
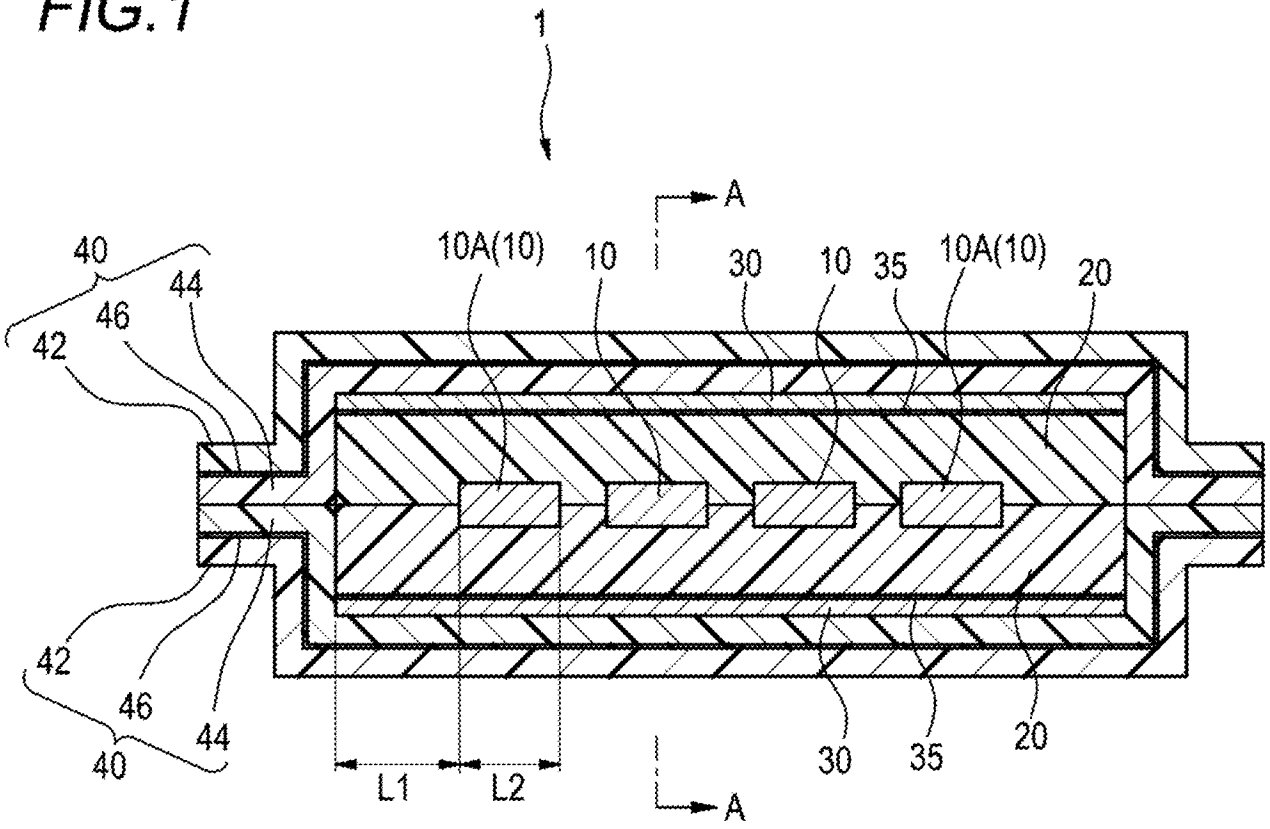
FIG. 1 is a sectional view (cross-sectional view) in a plane perpendicular to a longitudinal direction of a flat cable according to an embodiment.

An object of the present invention is to provide a shielded flat cable capable of improving transmission characteristics.

Advantageous Effects of Invention

According to the present invention, it is possible to provide a shielded flat cable capable of improving transmission characteristics.

Description of Embodiments of Present Application

First, contents of the embodiments of the present invention will be listed and described.

(1) A shielded flat cable according to the embodiments of the present invention including:

a plurality of flat conductors arranged in parallel;

a pair of resin insulating layers sandwiching the plurality of flat conductors from both sides of a parallel surface of the plurality of flat conductors, and covering portions other than end portions of the plurality of flat conductors in a length direction;

a pair of shield layers in contact with an outer surface of at least one resin insulating layer of the pair of resin insulating layers; and a pair of first resin films with an adhesive covering an outer surface of the pair of resin insulating layers or the shield layer, wherein a dielectric loss tangent of the resin insulating layer, of the pair of resin insulating layers, in contact with the shield layer is 0.001 or less at 10 GHz, and wherein the adhesive or the pair of first resin films is made of a flame retardant material.

According to the configuration, the dielectric loss tangent is lower than that of the flat cable in related art, so that the transmission characteristics can be improved. Further, the adhesive or the first resin film outside of the shield layer is made of a flame retardant material, so that the flame retardance of the shielded flat cable can be maintained.

(2) The shielded flat cable, wherein in a parallel direction of the plurality of flat conductors, an end portion of the shield layer is on an outer side with respect to an end portion of the outermost flat conductor among the plurality of flat conductors by a half or more of a width dimension of the outermost flat conductor, and wherein the end portion in the parallel direction of the shield layer may be covered with the resin insulating layer.

(3) The shielded flat cable, wherein in a parallel direction of the plurality of flat conductors, an end portion of the shield layer is on an outer side with respect to an end portion of the outermost flat conductor among the plurality of flat conductors by a half or more of a width dimension of the outermost flat conductor, and wherein the end portion in the parallel direction of the shield layer may be covered with the first resin film.

According to the configurations (2) and (3), the shield layer is on the outer side with respect to the end portion of the flat conductor, so that noise resistance and high frequency characteristics of the flat cable can be properly maintained, and since the end portion in the conductor parallel direction of the shield layer is not exposed, a defect (such as the occurrence of a spark) at the time of withstand voltage test after cable formation can be prevented.

(4) The shielded flat cable, further including:

a grounding member attached to an end portion in the length direction, wherein a portion of the shield layer may be exposed from the first resin film, and the grounding member may be in contact with the shield layer at the exposed portion.

According to the configuration, the grounding member is provided, so that the shielded flat cable can be reliably grounded.

(5) The shielded flat cable, wherein the shield layer may be exposed at an end portion in the length direction.

According to the configuration, it is possible to perform grounding by the shield layer without using the grounding member, and to realize a reduction in production cost and in thickness.

(6) The shielded flat cable, wherein at an end portion in the length direction, each of the plurality of flat conductors may be completely exposed from the resin insulating layers.

(7) The shielded flat cable, further including:

a grounding member superimposed on and in contact with the outer surface of the shield layer at the end portion in the length direction, wherein the first resin film may cover the shield layer and the grounding member.

(8) The shielded flat cable, wherein a portion of the grounding member may protrude from the first resin film, and the protruding portion may be arranged in parallel with the plurality of flat conductors.

According to the configuration, a ground terminal can be connected to a circuit board or the like at the same time as a signal terminal by equalizing positions in the length direction in which the flat conductor and the grounding member are attached to the circuit board or the like. Further, the configuration of the circuit arrangement can be simplified. In addition, when mounted on the circuit board, the impedance can be adjusted by adjusting the thickness of the grounding member or the like.

(9) The shielded flat cable, further including:

a second resin film covering the first resin film, wherein the second resin film may be bonded to at least a part of exposed portions of the plurality of flat conductors.

(10) The shielded flat cable, further including:

a third resin film bonded to at least a part of exposed portions of the plurality of flat conductors, wherein the shield layer may be bonded to an outer surface of the third resin film.

(11) The shielded flat cable, wherein the third resin film may be bonded to the resin insulating layer at the end portion in the length direction.

According to the configurations (9) and (11), the exposed portions of the flat conductors can be reinforced by the second resin film or the third resin film.

(12) The shielded flat cable, further including:

a third resin film bonded to exposed portions of the plurality of flat conductors and the shield layer at the end portion in the length direction; and a grounding member superimposed on and in contact with the outer surface of the shield layer and bonded to the third resin film.

According to the configuration, the grounding member can be reinforced by the third resin film together with the exposed portions of the flat conductors.

(13) The shielded flat cable, wherein at least a part of end portions of the resin insulating layers in the parallel direction of the flat conductors may be covered with the first resin film.

According to the configuration, at least a part of end portions of the shield layer in the width direction is not exposed, so that the flame retardance is further improved.

(14) The shielded flat cable, wherein an entire surface of the end portions of the resin insulating layers may be covered with the first resin film.

According to the configuration, it is possible to further improve the flame retardance and to prevent a defect at the time of withstand voltage test after cable formation.

Details of Embodiments of the Present Application

Hereinafter, examples of embodiments of shielded flat cables according to the invention will be described with reference to the drawings.

FIG. 1 is a sectional view (cross-sectional view) in a direction perpendicular to a length direction of a shielded flat cable (hereinafter, referred to as flat cable) 1 according to a first embodiment. The flat cable 1 according to the present embodiment is a cable used to electrically connect devices or for wiring in the devices.

As shown in FIG. 1, the flat cable 1 includes a plurality of (four in this case) flat conductors 10, a pair of resin insulating layers 20, a pair of shield layers 30, and a pair of resin films 40 (an example of a first resin film).

The plurality of flat conductors 10 are arranged in a plane. Each flat conductor 10 is made of, for example, a tin-plated copper conductor. The flat conductor 10 is formed in a substantially flat rectangular shape in a cross section. In the present embodiment, the flat cable 1 includes four flat conductors 10, but the number of the flat conductors 10 is optional.

The pair of resin insulating layers 20 are layers for securing the pressure resistance and high frequency characteristics of the flat cable 1, and are formed of, for example, a resin such as polyethylene, polypropylene, polyimide, polyethylene terephthalate, polyester, or polyphenylene sulfide.

The resin insulating layer 20 electrically insulates between the plurality of flat conductors 10, and intervenes between the flat conductors 10 and the shield layer 30 to function as a capacitor for forming electrostatic coupling for use in a high frequency region. Therefore, the resin insulating layer 20 is also referred to as a dielectric, and the dielectric loss tangent (tan δ) of the resin material configuring the resin insulating layer 20 is a parameter that influences the transmission characteristics of the flat cable 1. The dielectric loss tangent is preferably small in terms of reducing dielectric loss (insertion loss).

In the present embodiment, for example, the resin material configuring the resin insulating layer 20 does not contain a flame retardant. A resin material in which the flame retardant is not blended (for example, polypropylene) has a dielectric loss tangent of about 0.0002 at 10 GHz, which is smaller than a dielectric loss tangent of a resin material in which the flame retardant is blended (for example, the dielectric loss tangent is about 0.0023 at 10 GHz). Therefore, when the resin insulating layer 20 is formed of the resin material not containing a flame retardant, the dielectric loss of a high frequency signal is particularly reduced as a result of the smaller dielectric loss tangent, which is preferable. Since the dielectric loss tangent of polyimide is about 0.001 at 10 GHz, the dielectric loss tangent of the resin insulating layer 20 in the present embodiment is preferably 0.001 or less.

The pair of resin insulating layers 20 are bonded to each other in a state where the plurality of flat conductors 10 arranged in the plane are sandwiched from both sides of a parallel surface. Accordingly, the plurality of flat conductors 10 are covered by the pair of resin insulating layers 20.

The pair of shield layers 30 are layers provided with a shield function for securing noise resistance and high frequency characteristics of the flat cable 1, and are formed of, for example, metal foil such as copper foil or aluminum foil. An adhesive layer 35 (hereinafter, referred to as anchor coat layer 35) for adhering the resin insulating layer 20 and the shield layer 30 is provided between the resin insulating layer 20 and the shield layer 30. Any material can be used as the anchor coat layer 35. For example, a urethane-based anchor coat material in which an isocyanate-based curing agent is mixed with polyurethane, which is a main ingredient, can be used.

The pair of shield layers 30 is disposed such that the anchor coat layers 35 are respectively in contact with outer surfaces (surfaces opposite to the adhesive surfaces with flat conductor 10) of the pair of resin insulating layers 20. The pair of shield layers 30 are respectively bonded to the resin insulating layers 20 such that both end portions in a parallel direction of the plurality of flat conductors 10 (hereinafter, referred to as conductor parallel direction) substantially coincide with both end portions in the conductor parallel direction of the resin insulating layers 20. That is, the pair of shield layers 30 is disposed such that both end portions in the conductor parallel direction are on an outer side with respect to end portions on the outer side of the outermost flat conductors 10A among the plurality of flat conductors 10 in the conductor parallel direction. Specifically, a parallel pitch of the flat conductors 10 and a width dimension of the shield layer 30 are set such that a distance L1 between the end portion on the outer side of the flat conductor 10A and the end portion of the shield layer 30 in the conductor parallel direction is equal to or more than a half of a width dimension L2 of the flat conductor 10A. Accordingly, noise resistance and high frequency characteristics of the flat cable 1 can be properly maintained.

Each of the pair of resin films 40 includes a base layer 42, a flame retardant insulating layer 44, and an adhesive layer 46 (hereinafter, referred to as anchor coat layer 46). The base layer 42 is a layer for securing the pressure resistance of the flat cable 1, and is made of, for example, polyethylene terephthalate. The flame retardant insulating layer 44 is a layer for adhering the resin insulating layer 20 or the shield layer 30 to the base layer 42 while securing the flame retardance, pressure resistance, deterioration resistance or the like of the flat cable 1, and is made of, for example, a thermoplastic resin material. As the flame retardant insulating layer 44, for example, a thermoplastic polyester resin containing a phosphorus-based flame retardant or a nitrogen-based flame retardant can be adopted. The anchor coat layer 46 for adhering the base layer 42 and the flame retardant insulating layer 44 is provided between the base layer 42 and the flame retardant insulating layer 44. The material used as the anchor coat layer 46 can be optional, and for example, it is preferable to use the same material as the anchor coat layer 35 of the shield layer 30.

The pair of resin films 40 covers the shield layers 30 and outer surfaces of the resin insulating layers 20 at portions where the shield layer 30 is not attached. Each resin film 40 has a width dimension in the conductor parallel direction larger than the width dimension of the resin insulating layer 20 and the shield layer 30. That is, both end portions (hereinafter, referred to as end portions on both sides) of the resin films 40 in the conductor parallel direction extend to the outer side with respect to end portions on both sides of the resin insulating layers 20 and the shield layers 30. The entire surfaces of the end portions on both sides of the resin insulating layers 20 and the shield layers 30 are covered with the extended pair of resin films 40. Further, the end portions on both sides of the base layers 42 of the pair of resin films 40 are bonded to each other via the flame retardant insulating layers 44 and the adhesive layers 46. As described above, the pair of resin films 40 are bonded at end portions on both sides in the conductor parallel direction, so that the end portions on both sides of the resin films 40 can be prevented from being peeled off.

Figure 2:
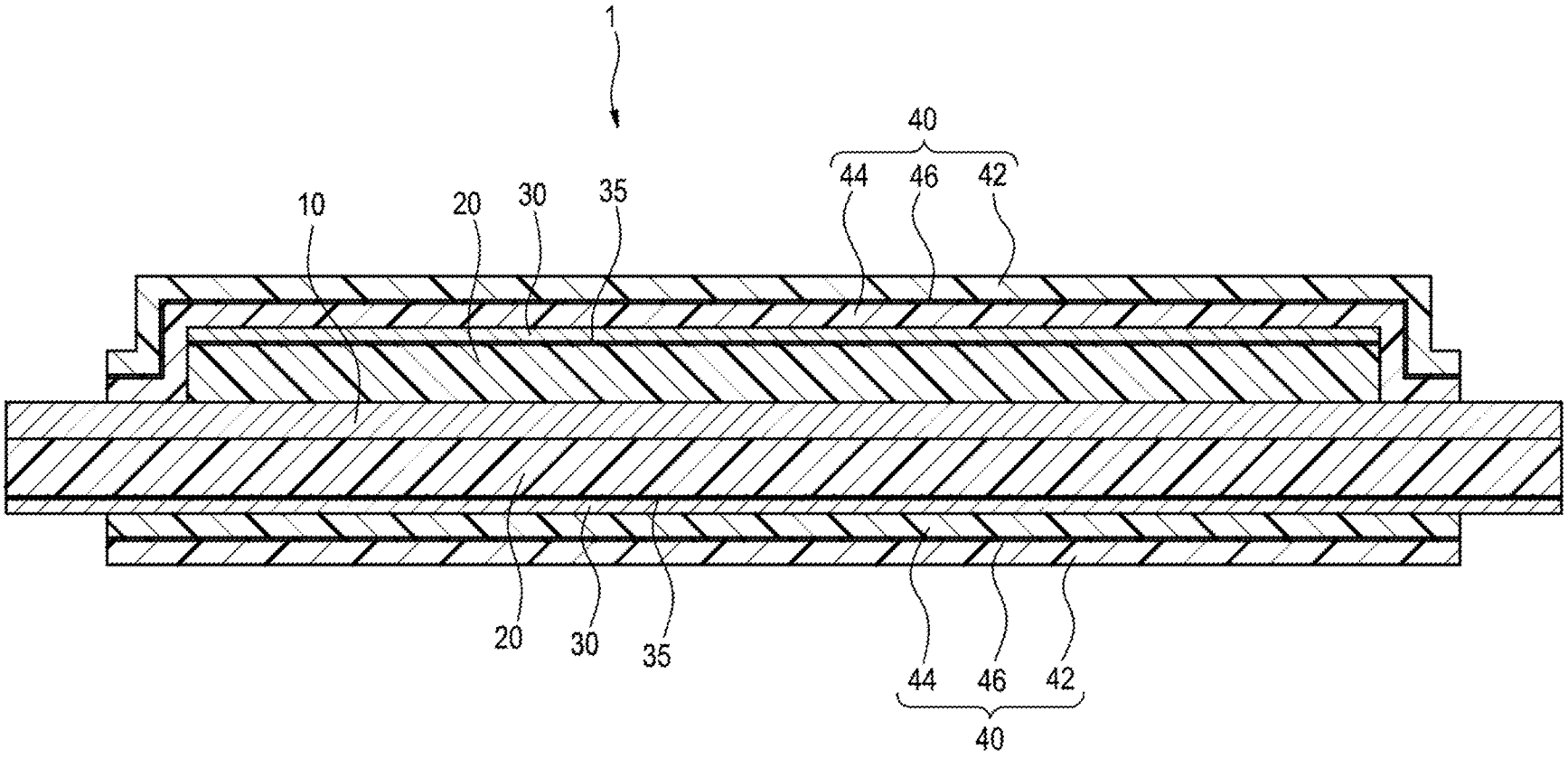
FIG. 2 is a sectional view (longitudinal sectional view) of the flat cable of FIG. 1 taken along a line A-A.

FIG. 2 is a longitudinal sectional view of the flat cable 1 taken along the line A-A.

As shown in FIG. 2, the resin insulating layer 20 and the shield layer 30 are removed by a predetermined length on one surface (upper surface in FIG. 2) at both end portions of the flat cable 1 in the length direction (hereinafter, referred to as cable length direction), so that the flat conductor 10 is exposed. The pair of resin films 40 are bonded to the outer surfaces of the pair of shield layers 30 so as to cover a part of the exposed portion of the flat conductor 10 at both ends in the cable length direction. That is, in the flat cable 1, the flat conductor 10 is exposed on one surface and the shield layer 30 is exposed on the other surface at both end portions in the length direction. The end portion in the cable length direction of the flat cable 1 configured as described above is directly inserted and connected to a connecting member (not shown).

Figure 4:
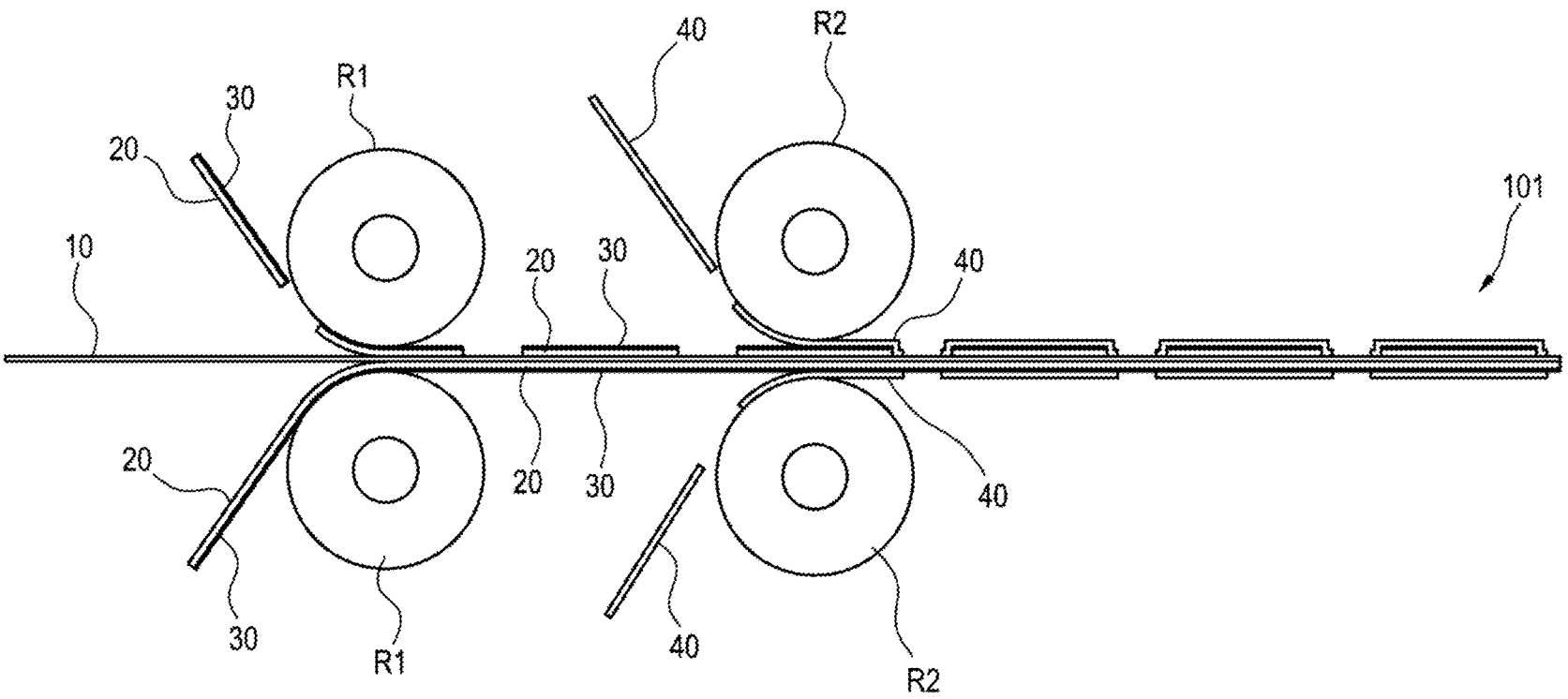
FIG. 4 is a schematic view showing a method for manufacturing the flat cable of FIG. 1.
Figure 5:
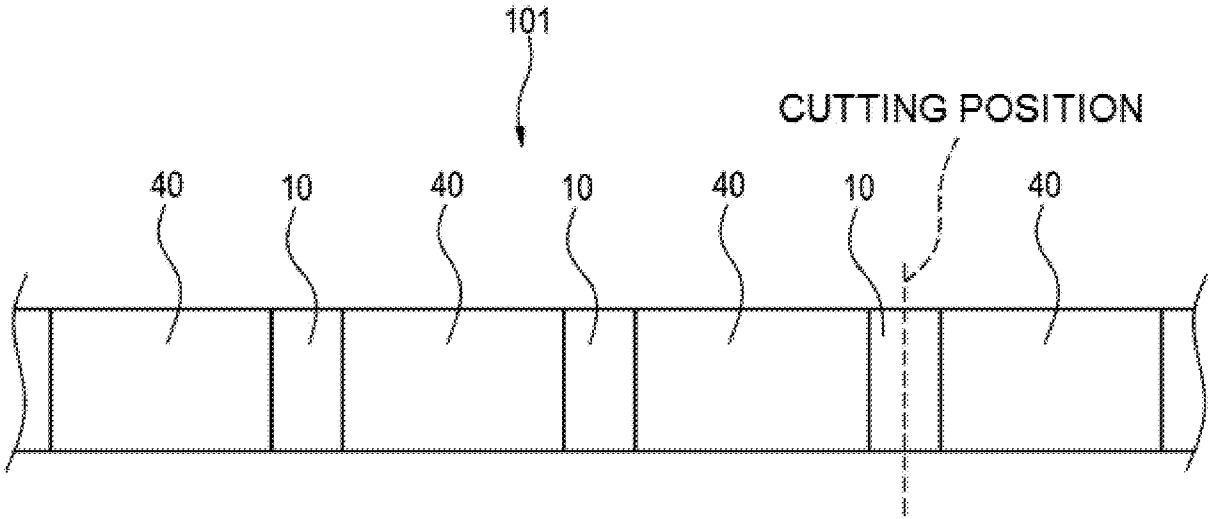
FIG. 5 is a view showing a long cable manufactured by the method shown in FIG. 4.

Next, a method for manufacturing the flat cable 1 according to the present embodiment will be described using FIGS. 3 to 5. The basic concept of the method for manufacturing the flat cable 1 is the same as in the modifications and a second embodiment described later.

Figure 3:
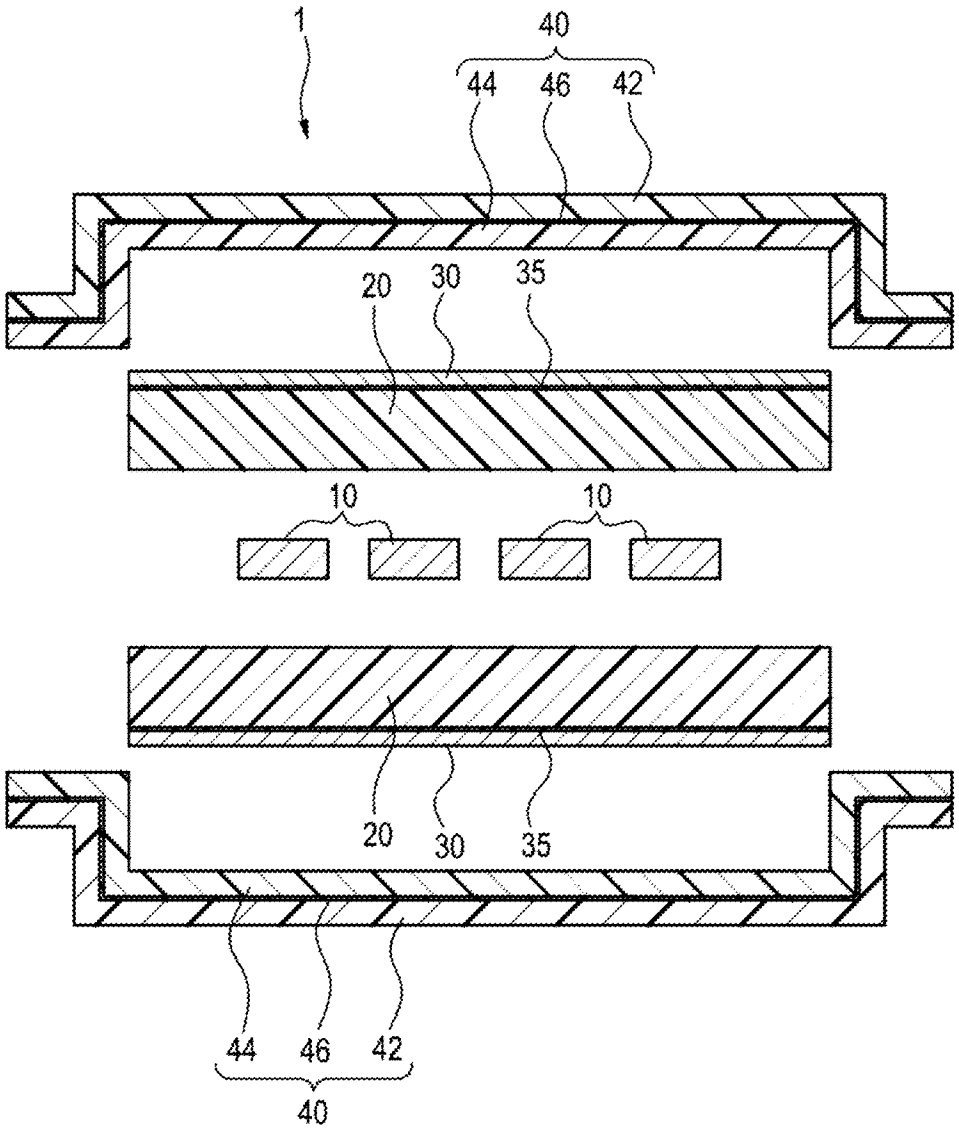
FIG. 3 is a schematic view showing a method for manufacturing the flat cable of FIG. 1.

As shown in FIG. 3, it is preferable to bond the resin insulating layer 20 and the shield layer 30 in advance via the anchor coat layer 35. As shown in FIG. 4, a plurality of flat conductors 10 are supplied in parallel at a predetermined interval between a pair of laminate rollers R1, R1 facing and pressing with each other. Each flat conductor 10 is unwound from a bobbin (not shown). Next, the resin insulating layer 20 to which the shield layer 30 is bonded is supplied to both sides of the parallel surface of the flat conductors 10 between the pair of laminate rollers R1, R1. Here, on the upper surface side of FIG. 4, the resin insulating layer 20 with the shield layer 30 is supplied to the pair of laminate rollers R1, R1 at a predetermined interval in the cable length direction; and on the lower surface side of FIG. 4, the resin insulating layer 20 with the shield layer 30 is continuously supplied to the pair of laminate rollers R1, R1. Then, the pair of laminate rollers R1, R1 presses the pair of resin insulating layers 20 with the shield layer 30 sandwiching the flat conductor 10 at a predetermined interval to bond the resin insulating layers 20 to each other.

Next, the resin film 40 is supplied to outer sides of both the upper and lower shield layers 30 at predetermined intervals in the cable length direction between a pair of laminate rollers R2, R2 facing and pressing with each other. Then, the pair of resin films 40 sandwiching the shield layer 30 are pressed by the pair of laminate rollers R2, R2, and the resin films 40 are bonded to each other to form a long cable 101. At last, as shown in FIG. 5, the long cable 101 produced as described above is cut at a portion where the flat conductor 10 is exposed from the resin film 40, so as to obtain the flat cable 1 (see FIGS. 1 and 2). Thus, by making the length of the resin insulating layer 20 with the shield layer 30 supplied to the laminate rollers R1, R1 on the upper surface side in FIG. 4 correspond to a desired length of the flat cable 1, the flat cable 1 having a desired length can be easily produced.

As described above, in the present embodiment, the flat cable 1 includes the plurality of flat conductors 10 arranged in parallel; the pair of resin insulating layers 20 sandwiching the flat conductors 10 from both sides of the parallel surface of the plurality of flat conductors 10 and covering portions other than the end portions in the length direction of the flat conductor 10; the pair of shield layers 30 respectively in contact with the outer surfaces of the pair of resin insulating layers 20; and the pair of resin films 40 covering the outer surfaces of the pair of resin insulating layers 20 or the pair of shield layers 30. The dielectric loss tangent of the pair of resin insulating layers 20 is 0.001 or less at 10 GHz, and the flame retardant insulating layer 44 configuring the resin film 40 is made of a flame retardant material (a flame retardant is included). According to this configuration, the dielectric loss tangent of the resin insulating layer 20 is lower than that of the flat cable in related art, so that the transmission characteristics of the flat cable 1 can be improved. Further, since the resin film 40 is made of a flame retardant material, the flame retardance of the flat cable 1 can be maintained.

When an end portion of a shield layer in the conductor parallel direction is exposed, the exposed portion of the metal configuring the shield layer may spark during a withstand voltage test after a flat cable is produced and the withstand voltage test may not be performed. To address the above matters, in the flat cable 1 of the present embodiment, the end portion (side end) of the shield layer 30 in the conductor parallel direction is covered with the resin film 40, and the metal portion is not exposed at the side end of the flat cable 1, so that a defect such as the occurrence of a spark at the time of withstand voltage test after cable formation can be prevented.

In the flat cable 1, the shield layer 30 is exposed on one surface side of both end portions in the length direction. Accordingly, it is also possible to perform grounding directly by the shield layer 30 without using a grounding member described later. Therefore, it is possible to reduce the production cost of the flat cable 1 and reduce the thickness thereof.

Figure 6:
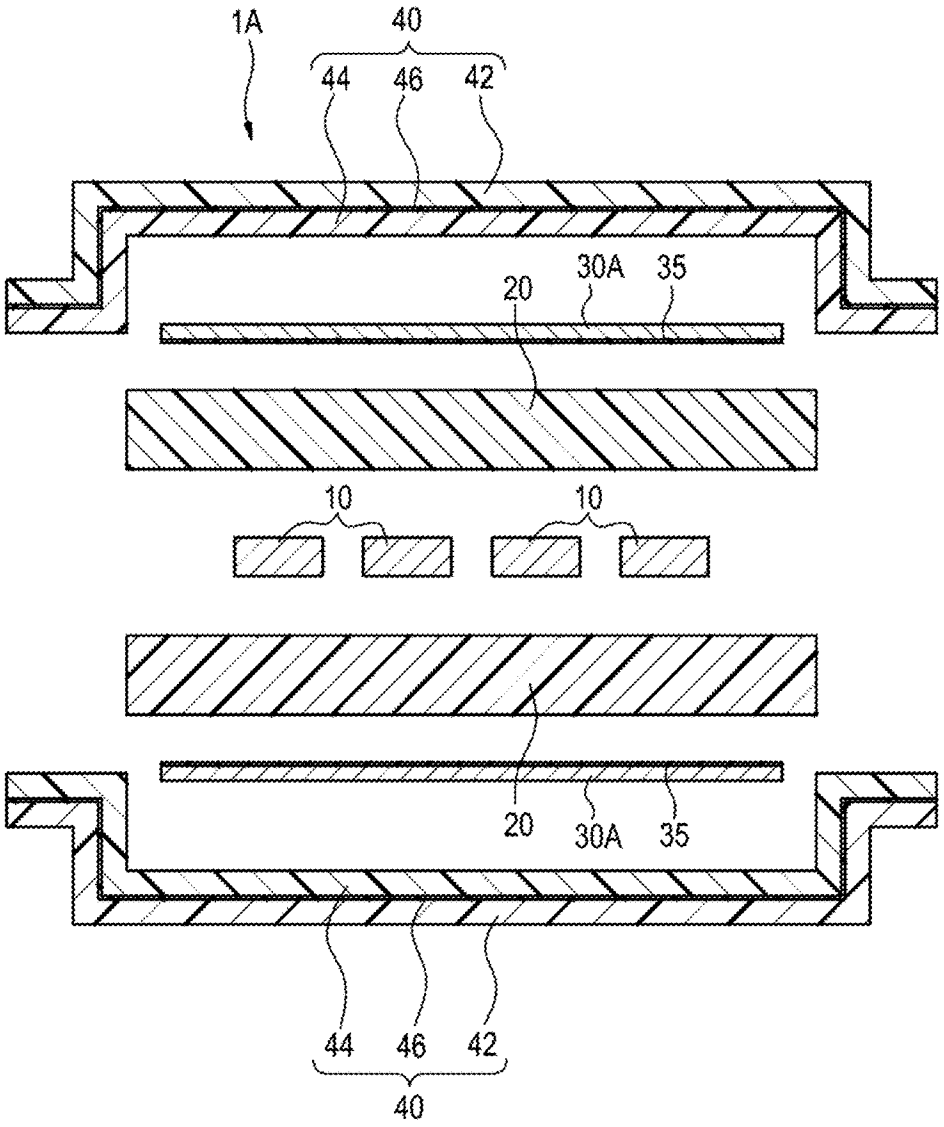
FIG. 6 is an exploded view in a cross-sectional direction of a flat cable according to a first modification.
Figure 7:
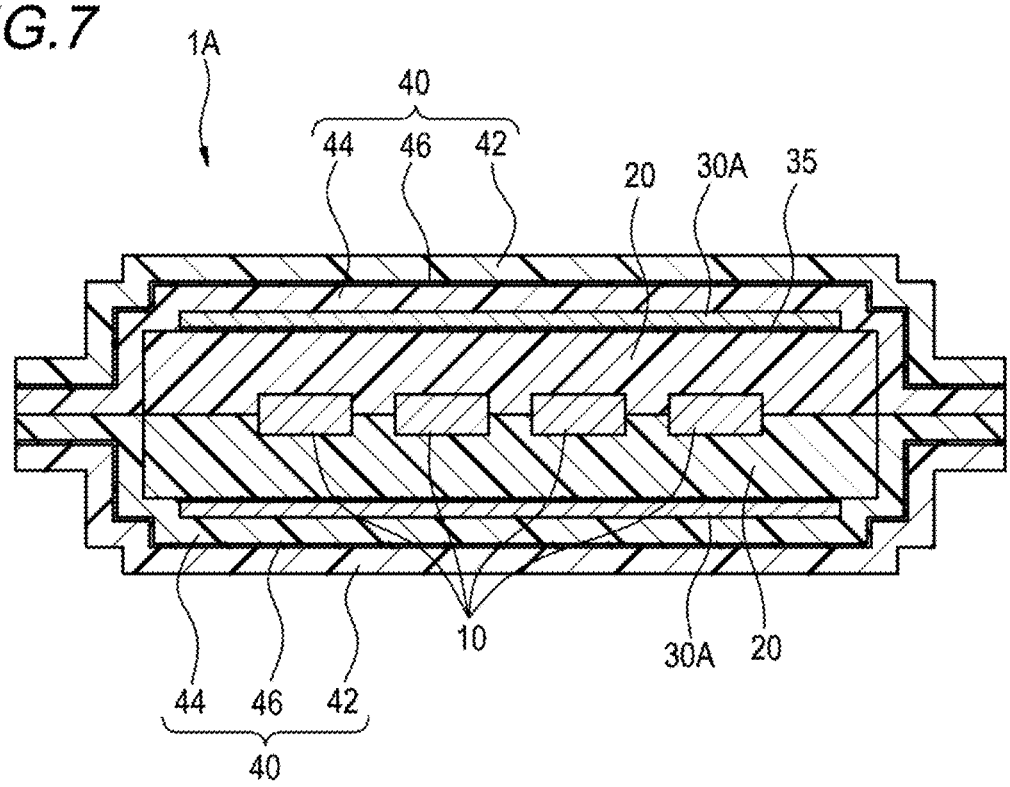
FIG. 7 is a cross-sectional view of the flat cable shown in FIG. 6.

FIG. 6 is an exploded view in a cross-sectional direction of a flat cable 1A according to a first modification, and FIG. 7 is a cross-sectional view of the flat cable 1A.

In the method for manufacturing the flat cable 1 of the first embodiment described above, the resin insulating layer 20 and the shield layer 30 are bonded in advance via the anchor coat layer 35, and the pair of resin insulating layers 20 with the shield layer 30 are bonded so as to sandwich the plurality of flat conductors 10 in parallel, but the present invention is not limited thereto. As shown in FIG. 6, in the flat cable 1A, the resin insulating layer 20 and a shield layer 30A are not bonded in advance, and the shield layer 30A is bonded to the outer surface of the resin insulating layer 20 via the anchor coat layer 35 after the pair of resin insulating layers 20 are bonded with the flat conductors 10 being sandwiched in parallel.

In the flat cable 1 according to the first embodiment, the width dimension of the resin insulating layer 20 and the width dimension of the shield layer 30 substantially coincide with each other, but the present invention is not limited thereto. When the distance between an end portion of the outermost flat conductor 10A and an end portion of the shield layer 30A in the conductor parallel direction is equal to or more than a half of the width dimension of the flat conductor 10A, the width dimension of the shield layer 30A may be smaller than the width dimension of the resin insulating layer 20 as shown in FIG. 7. In the flat cable 1A, the pair of resin films 40 are bonded to each other to stepwisely cover both end portions of the shield layers 30A and both end portions of the resin insulating layers 20.

Figure 8:
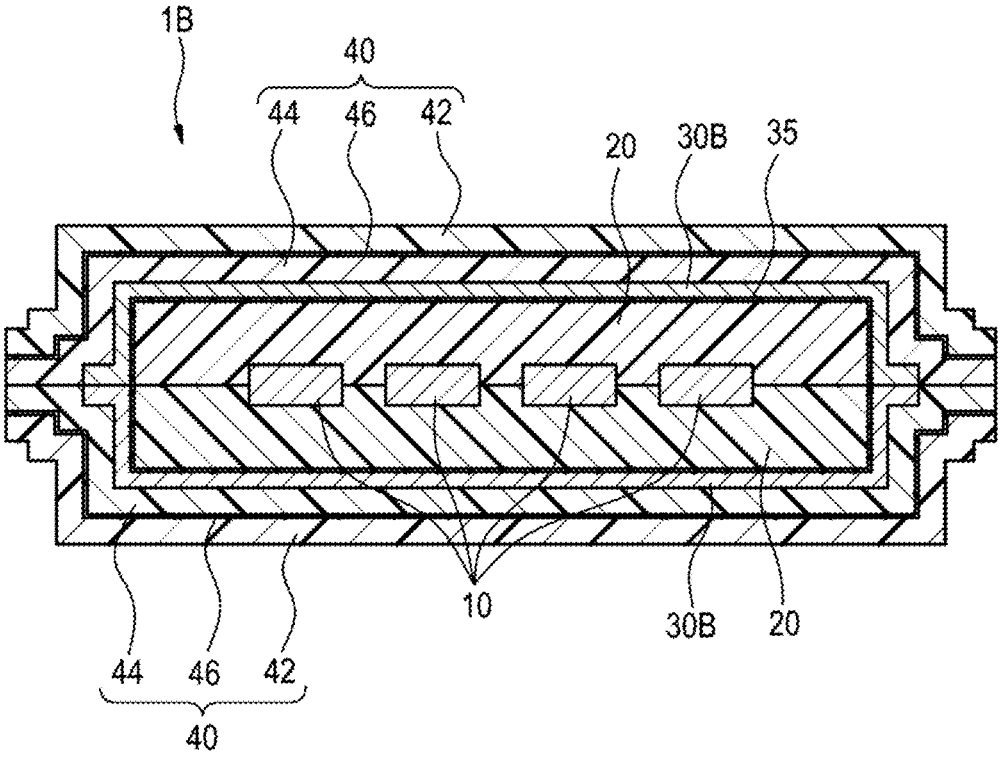
FIG. 8 is a cross-sectional view of a flat cable according to a second modification.

FIG. 8 is a cross-sectional view of a flat cable 1B according to a second modification.

As shown in FIG. 8, in the second modification, the width dimension of a shield layer 30B is larger than the width dimension of the resin insulating layer 20. Both end portions (extending portions) of the pair of shield layers 30B cover both end surfaces of the resin insulating layers 20 in the conductor parallel direction, and the pair of shield layers 30B are bonded to each other. That is, the entire periphery of the pair of resin insulating layers 20 in the cross-sectional view is covered by the shield layers 30B. The flat cable 1B is formed by bonding the pair of resin films 40 so as to cover the outer surfaces of the pair of shield layers 30B. As described above, the pair of shield layers 30B is bonded to each other, so that the shield layers 30B are electrically connected to each other. Therefore, during operation of an electronic device in which the flat cable 1B is used, noise of a signal generated from the electronic circuit of the electronic device can be collectively released from both shield layers 30B.

Figure 9:
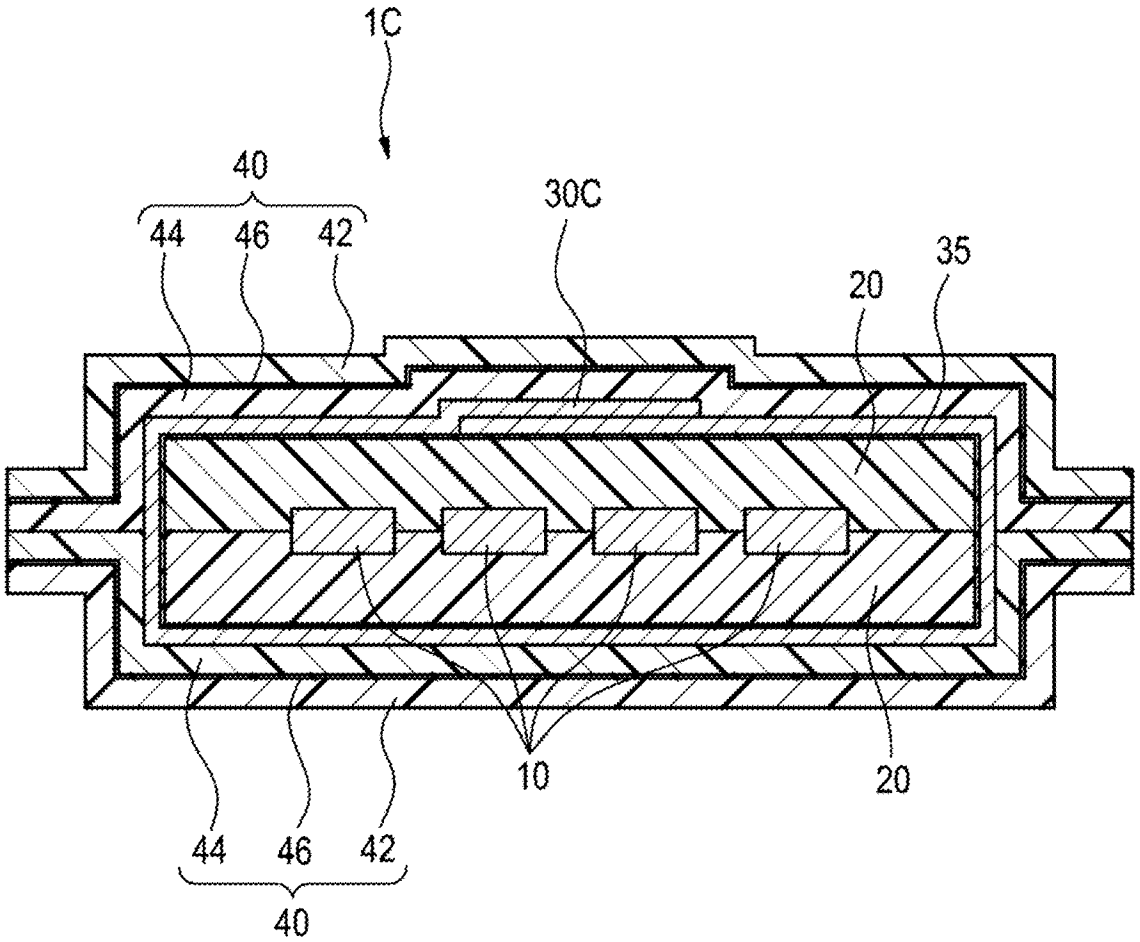
FIG. 9 is a cross-sectional view of a flat cable according to a third modification.

FIG. 9 is a cross-sectional view of a flat cable 1C according to a third modification.

As shown in FIG. 9, a shield layer 30C of the flat cable 1C is wound around the pair of resin insulating layers 20 sandwiching the flat conductors 10 so as to cover the entire periphery of the resin insulating layers 20 in the cross-sectional view. At this time, it is preferable that the shield layer 30C is wound around the periphery of the resin insulating layers 20 such that one side end is bonded to the other side end (two end portions of the shield layer 30 overlap with each other). The flat cable 1C is formed by bonding the pair of resin films 40 so as to cover the shield layer 30C wound around the resin insulating layers 20. In this configuration, noise can also be collectively released from the shield layer 30C as in the second modification.

Figure 10:
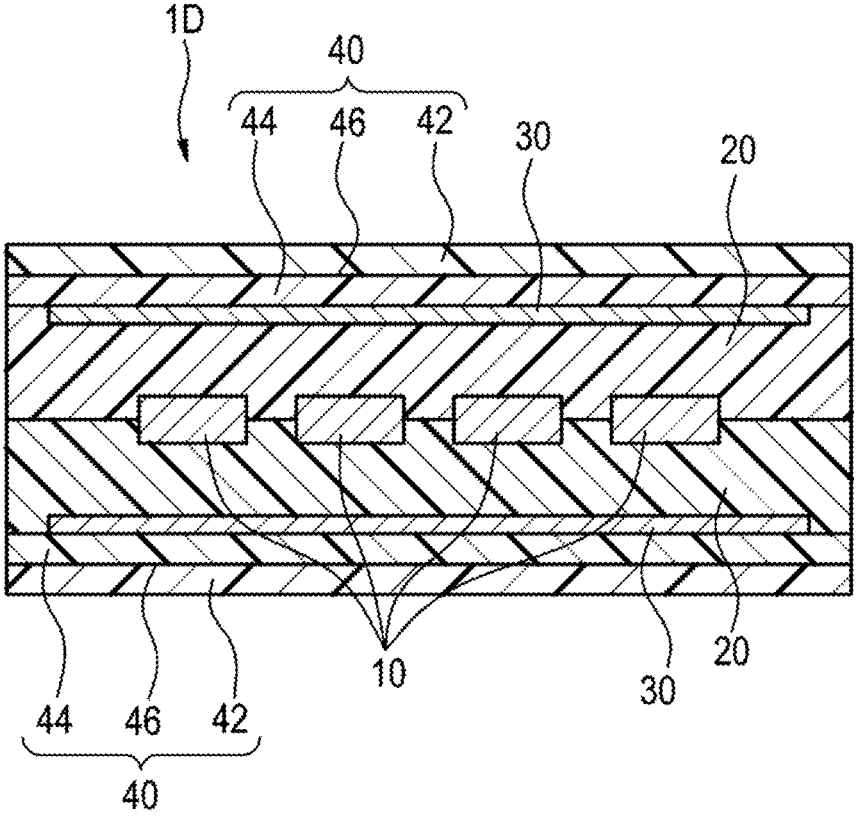
FIG. 10 is a cross-sectional view of a flat cable according to a fourth modification.

FIG. 10 is a cross-sectional view of a flat cable 1D according to a fourth modification.

Figure 27:
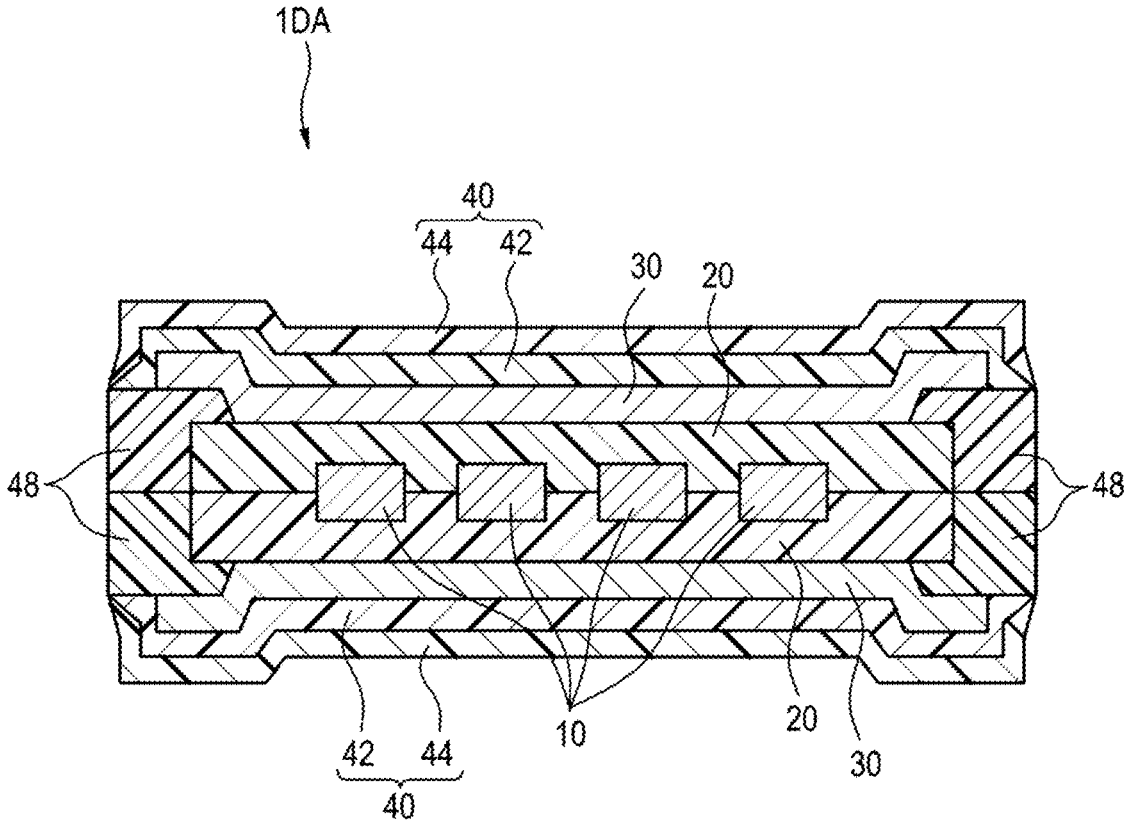
FIG. 27 is a cross-sectional view of a flat cable according to still another example of the fourth modification.

As shown in FIG. 10, in the flat cable 1D, positions of end portions on both sides of the pair of resin insulating layers 20 in the conductor parallel direction substantially coincide with those of the end portions on both sides of the pair of resin films 40. That is, the pair of resin insulating layers 20 is exposed at the end portions on both sides. Further, end portions on both sides of the shield layers 30 are covered by the resin insulating layers 20. According to such a flat cable 1D, the transmission characteristics can be improved as in the first embodiment. From the viewpoint of flame retardance, the configuration of the flat cable 1 according to the first embodiment is more preferable in which the end portions on both sides of the resin insulating layers 20 are covered by the resin films 40 containing the flame retardant material. For example, as shown in FIG. 27, the end portions on both sides of the resin insulating layers 20 may be covered with flame retardant insulating layers 48 which are made of the same flame retardant insulating material as the flame retardant insulating layers 44 of the resin films 40.

Figure 11:
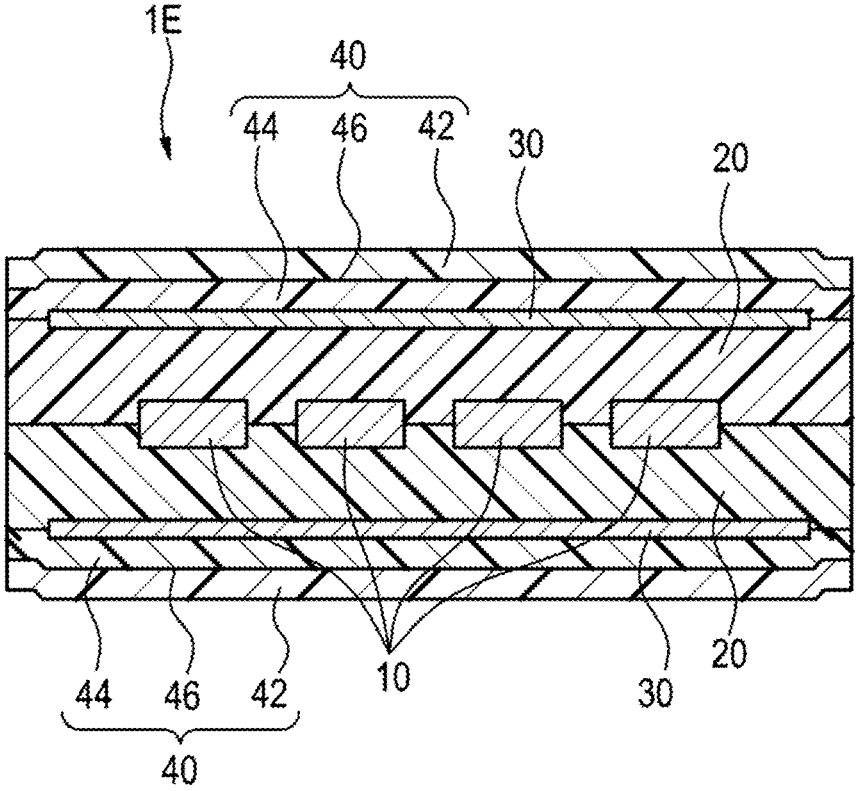
FIG. 11 is a cross-sectional view of a flat cable according to another example of the fourth modification.

In the flat cable 1D according to the fourth modification, the end portions on both sides of the shield layers 30 are covered with the resin insulating layers 20, but the present invention is not limited thereto. For example, as in a flat cable 1E shown in FIG. 11, at least a part of end portions on both sides of the shield layers 30 may be covered with the resin films 40. In this case, it is possible to prevent a failure at the time of withstand voltage test after cable formation.

Figure 12:
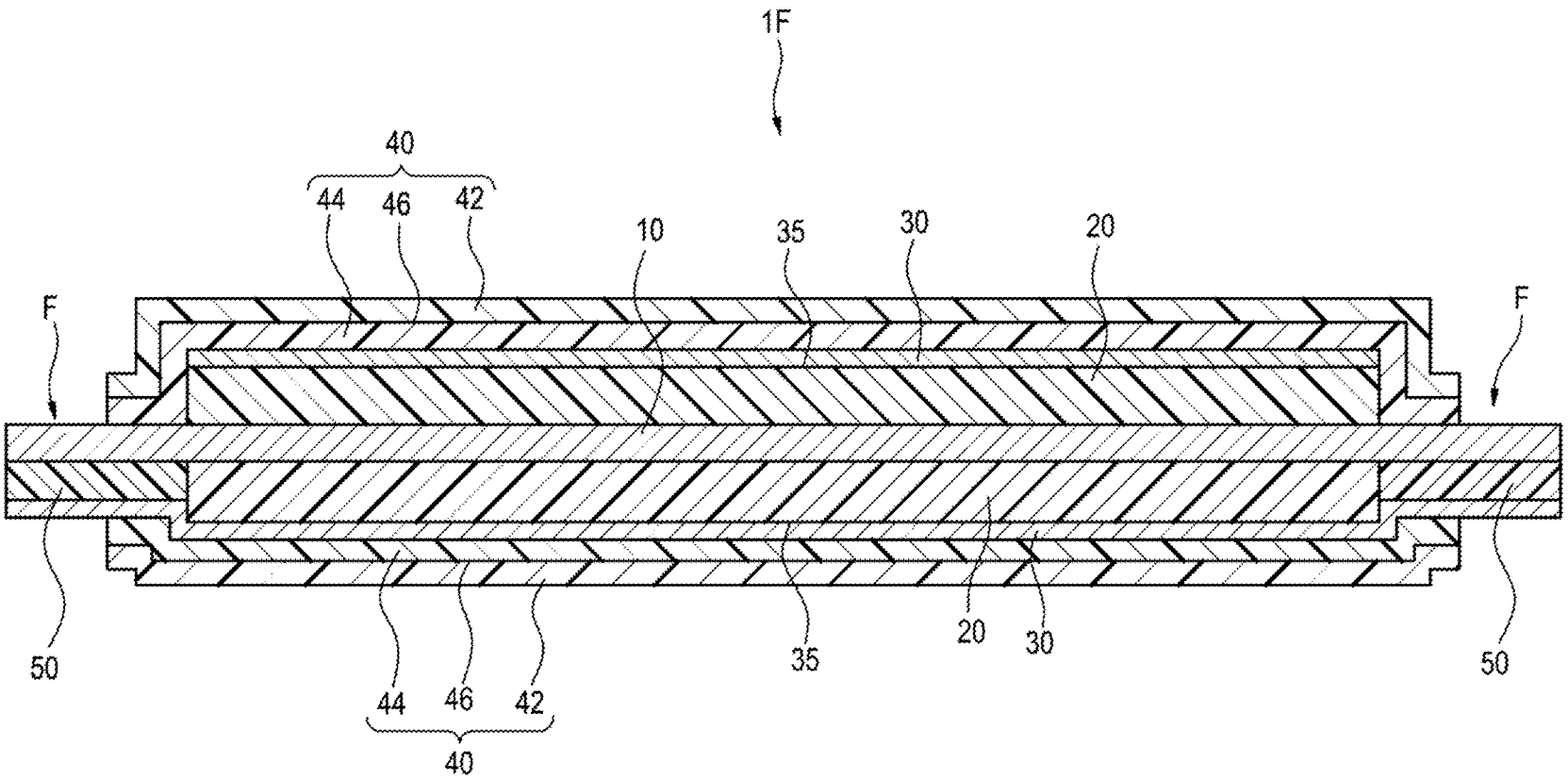
FIG. 12 is a longitudinal sectional view of a flat cable according to a fifth modification.

FIG. 12 is a longitudinal sectional view of a flat cable 1F according to a fifth modification.

As shown in FIG. 12, the resin insulating layer 20 and the shield layer 30 are removed by a predetermined length on one surface (upper surface in FIG. 12) at both end portions of the flat cable 1F in the length direction, so that the flat conductor 10 is exposed (exposed portions are indicated by a symbol F in FIG. 12). On the other hand, the resin insulating layer 20 is removed by a predetermined length on the other surface (lower surface in FIG. 12) of the flat cable 1F, and a resin film 50 (an example of a third resin film) different from the resin film 40 intervenes between the flat conductor 10 and the shield layer 30 at portions where the resin insulating layer 20 is removed. That is, the resin film 50 is bonded to at least a part of the exposed portion F of the plurality of flat conductors 10, so as to bond one shield layer 30. Then, the pair of resin films 40 is bonded from the outer surfaces of the pair of shield layers 30. According to this configuration, the flat conductor 10 in a state of being exposed from the resin insulating layer 20 and the resin film 40 can be reinforced by the resin film 50. In the present embodiment, the resin film 50 may be made of the same resin material as the resin film 40 (for example, polyethylene terephthalate), and may also be made of a material different from the resin film 40 as long as the flat conductor 10 can be reinforced.

It is preferable that the pair of resin films 40 is bonded to each other to cover the part of the portions F of the flat conductor 10 exposed from the resin insulating layer 20. Therefore, the resin insulating layer 20 is not exposed, so that the flame retardance can be enhanced.

Figure 13:
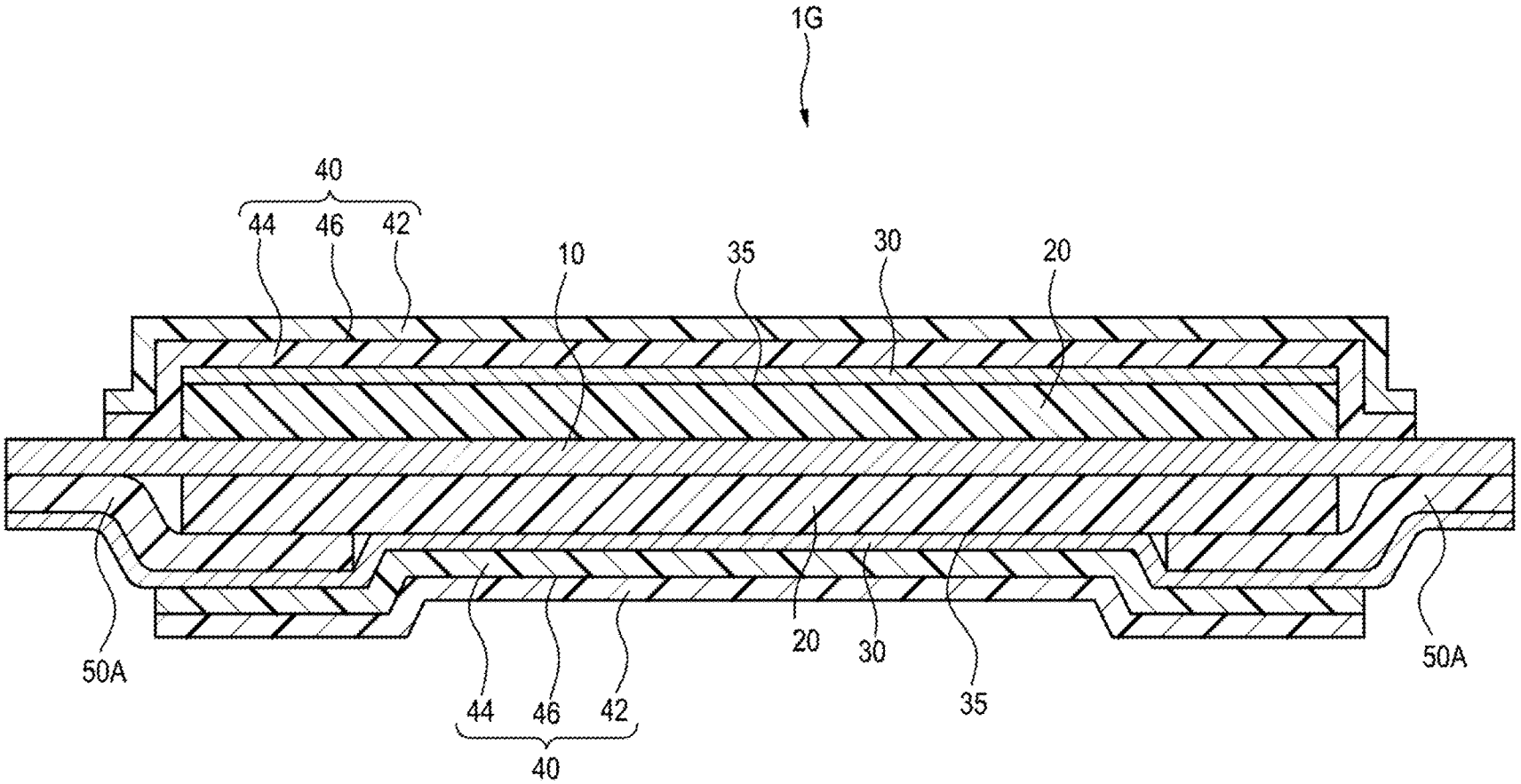
FIG. 13 is a longitudinal sectional view of a flat cable according to another example of the fifth modification.

In FIG. 12, the resin film 50 attached to one surface of the flat conductor 10 is disposed only between the portions F of the flat conductor 10 exposed from the resin insulating layer 20 and the shield layer 30, but the present invention is not limited thereto. For example, as in a flat cable 1G shown in FIG. 13, a resin film 50A may extend between the resin insulating layer 20 and the shield layer 30 in a portion where the flat conductor 10 is not exposed. That is, the resin film 50A may be bonded to the resin insulating layer 20 at the end portions in the cable length direction. According to this configuration, the exposed flat conductor 10 can be more reliably reinforced.

Figure 14:
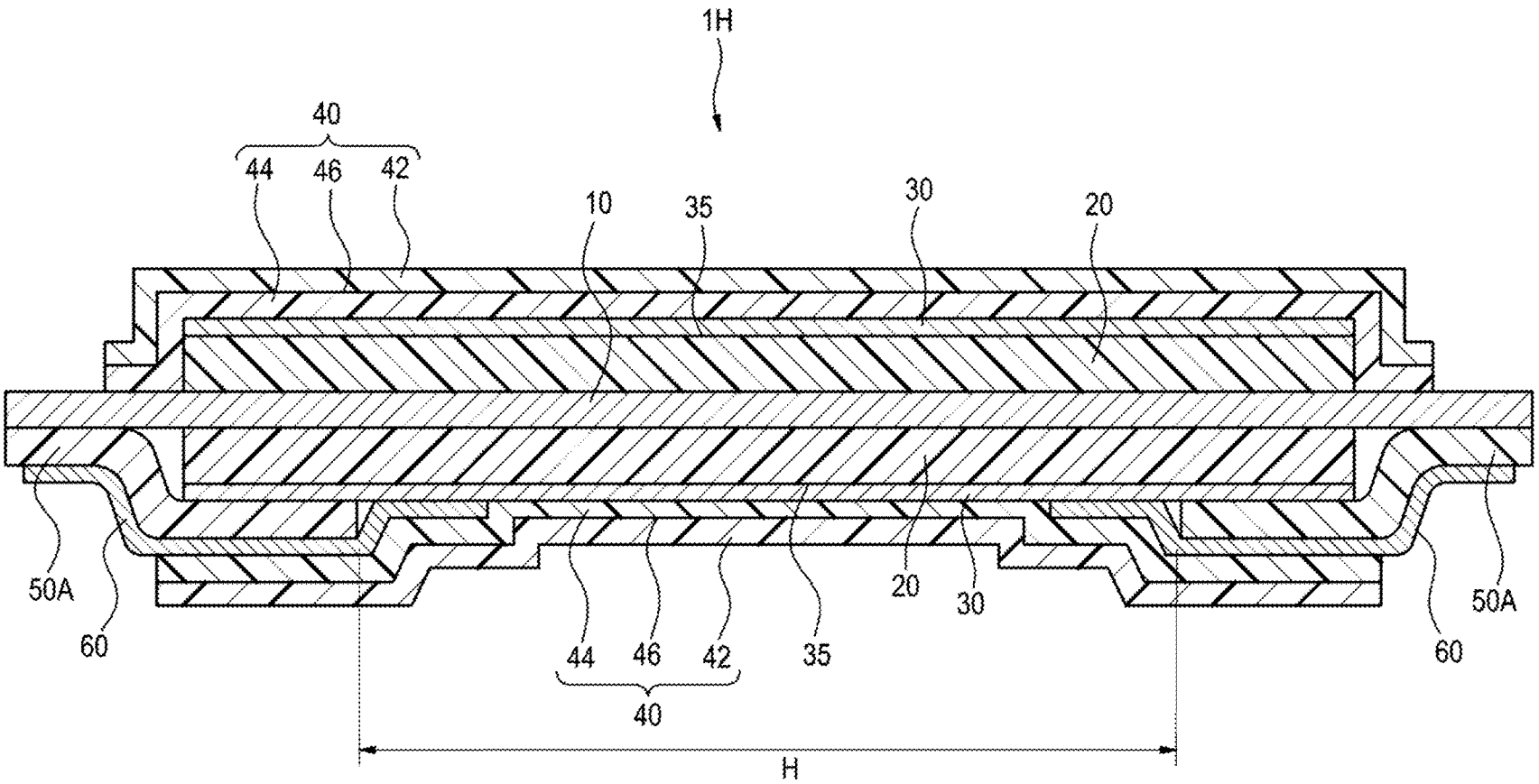
FIG. 14 is a longitudinal sectional view of a flat cable according to a sixth modification.

FIG. 14 is a longitudinal sectional view of a flat cable 1H according to a sixth modification.

As shown in FIG. 14, grounding members 60 are respectively attached to both end portions on one surface (lower surface in FIG. 14) of the flat cable 1H in the cable length direction so as to be electrically connected to the shield layer 30. The pair of resin insulating layers 20 and the pair of shield layers 30 are removed by a predetermined length on both surfaces (upper and lower surface of FIG. 14) of the flat cable 1H, so that the flat conductor 10 is exposed. A resin film 50A of a predetermined length is bonded to one surface (lower surface in FIG. 14) of the exposed portion of the flat conductor 10 so as to extend to one shield layer 30 of the pair of shield layers 30. In this shield layer 30, a portion H other than both end portions in the cable length direction is not covered by the resin film 50A.

The grounding members 60 are disposed to be in contact with the outer surface of the resin films 50A at both end portions in the cable length direction, and in contact with the shield layer 30 at the portion H which is not covered by the resin films 50A. Therefore, the shield layer 30 is electrically connected to the grounding members 60. Further, the pair of shield layers 30 and portions of the grounding members 60 other than both end portions are covered with the pair of resin films 40 so that the flat conductor 10, the resin films 50A, and the grounding members 60 are exposed at both end portions in the cable length direction. As in the fourth modification, it is preferable that the pair of resin films 40 are bonded to each other to cover a part of a portion of the flat conductor 10 exposed from the resin insulating layer 20 since the resin insulating layer 20 is not exposed. As described above, the grounding member 60 is provided at the end portion in the cable length direction, and a part of the grounding member 60 is covered by the resin film 40 together with the shield layer 30, so that the grounding member 60 for reliably and easily grounding the flat cable 1H can be integrated into the flat cable 1H.

Characteristics Evaluation

The transmission characteristics (signal attenuation amount) are compared and evaluated for a flat cable configured according to the first embodiment (including modifications) described above and a flat cable configured according to related art.

Figure 15:
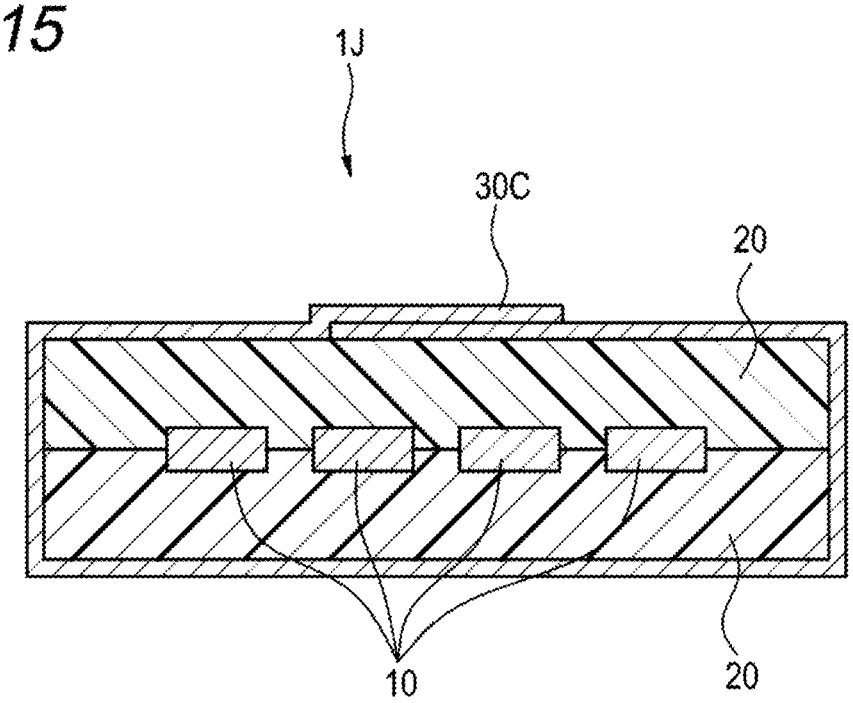
FIG. 15 is a cross-sectional view showing a flat cable used in signal attenuation evaluation of the present invention.

FIG. 15 is a cross-sectional view showing a flat cable configured according to the above embodiment and used in this evaluation. Specifically, a flat cable (hereinafter, referred to as cable 1J) in which the pair of resin films 40 are not bonded around the shield layer 30C of the flat cable 1C according to the third modification is adopted. The dielectric loss tangent of the cable 1J is 0.0002 at 10 GHz.

Figure 16:
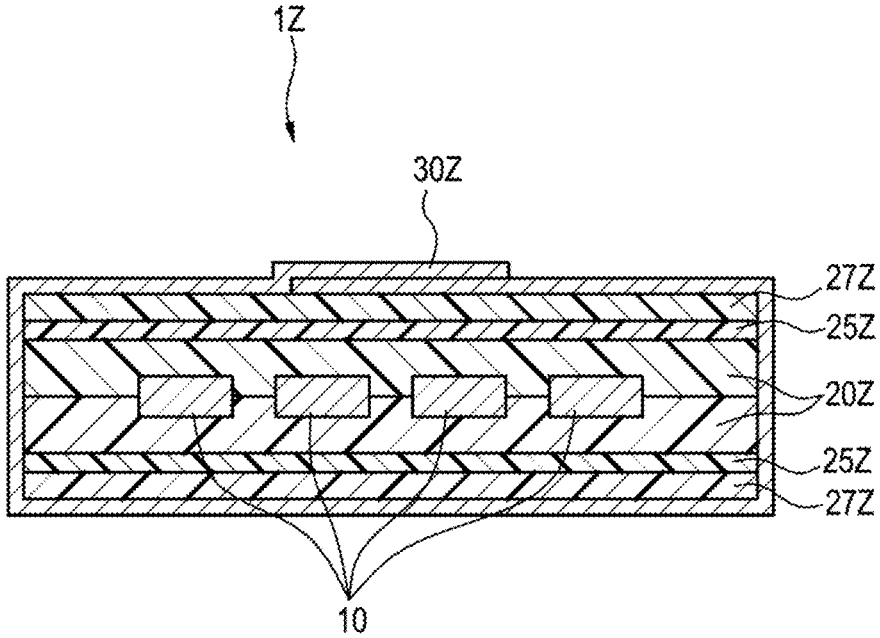
FIG. 16 is a cross-sectional view showing a flat cable according to a related art configuration used in the signal attenuation evaluation of the present invention.

FIG. 16 is a cross-sectional view showing a flat cable configured according to the related art and used in this evaluation. A cable 1Z shown in FIG. 16 uses the same flat conductors 10 as those of the above embodiment. A pair of resin insulating layers 20Z is bonded with four flat conductors 10 being sandwiched in parallel. The pair of resin insulating layers 20Z contains a flame retardant. The dielectric loss tangent of the cable 1Z is 0.0023 at 10 GHz. In the cable 1Z according to the related art, in order to ensure flame retardance, a pair of insulating base layers 25Z made of, for example, polyethylene terephthalate is provided on outer surfaces of a pair of resin insulating layers 20Z. Further, on outer surfaces of the pair of insulating base layers 25Z, for example, an intervening tape 27Z made of polyethylene or polyester is disposed, and a shield layer 30Z is wound around the intervening tape 27Z. The shield layer 30Z is made of the same material as the shield layer 30 of the present embodiment.

Figures 17, 18:
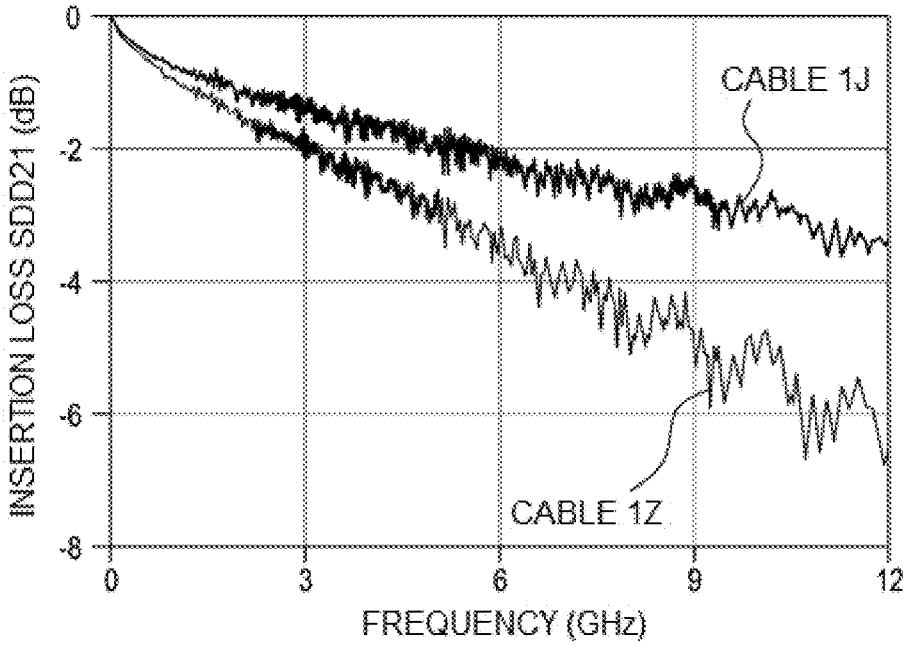
FIG. 17 is a graph showing frequency characteristics of signal attenuation amounts for the flat cable shown in FIG. 15 and the flat cable shown in FIG. 16.
FIG. 18 is a table showing improvement rates of the signal attenuation amounts for the flat cable shown in FIG. 15 and the flat cable shown in FIG. 16.

FIG. 17 is a graph showing frequency characteristics of signal attenuation amounts for the cable 1J shown in FIG. 15 and the cable 1Z shown in FIG. 16. In the graph shown in FIG. 17, the vertical axis represents a signal attenuation amount (dB), the horizontal axis represents frequency (GHz), and the frequency characteristics of signal attenuation amounts is shown. The signal attenuation amount is represented by insertion loss (SDD 21) of a differential mode in a plurality of flat conductors. As shown in FIG. 17, the drop of the signal attenuation amount of the cable 1Z according to the related art is larger than that of the cable 1J according to the present embodiment, and in particular, the signal attenuation amount of the cable 1Z drops significantly as the frequency band goes up.

For example, as shown in the table in FIG. 18, a signal attenuation amount at 5 GHz is −2.9 dB for the cable 1Z and −1.9 dB for the cable 1J, and an improvement rate of the signal attenuation amount for the cable 1J with respect to the cable 1Z is 34%. A signal attenuation amount at 10 GHz is −4.9 dB for the cable 1Z and −3.0 dB for the cable 1J, and an improvement rate of the signal attenuation amount for the cable 1J with respect to the cable 1Z is 39%. As described above, compared with the configuration (configuration according to related art) of the cable 1Z in which the insulating base layer 25Z or the intervening tape 27Z is disposed between the flat conductor 10 and the shield layer 30, in the configuration of the cable 1J according to the present embodiment in which an insulating base layer or an intervening tape is not disposed between the flat conductor 10 and the shield layer 30, it is confirmed that the transmission characteristics can be significantly improved since the dielectric loss tangent of the resin insulating layer 20 is lowered.

Second Embodiment

Figure 19:
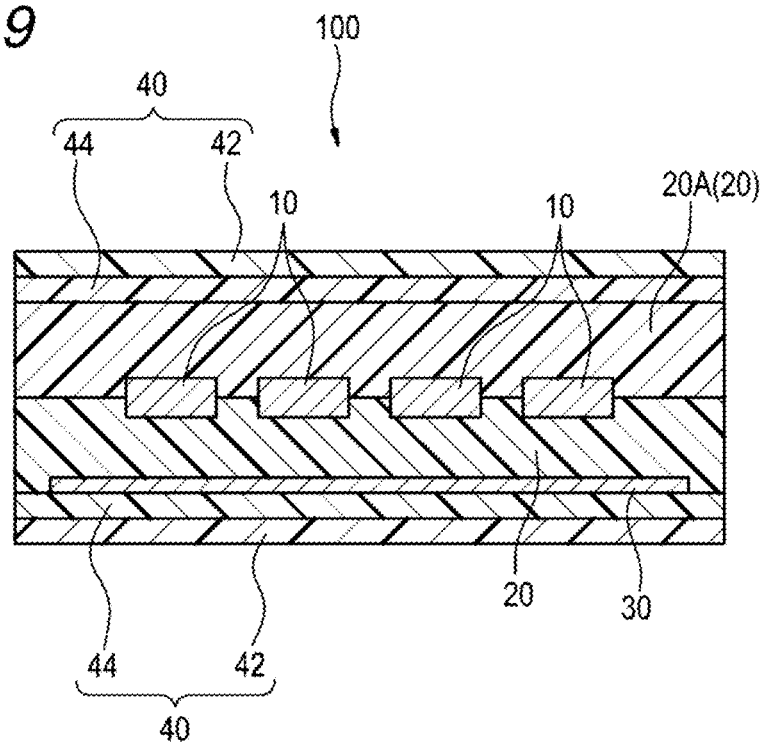
FIG. 19 is a cross-sectional view of a flat cable according to a second embodiment.
Figure 20:
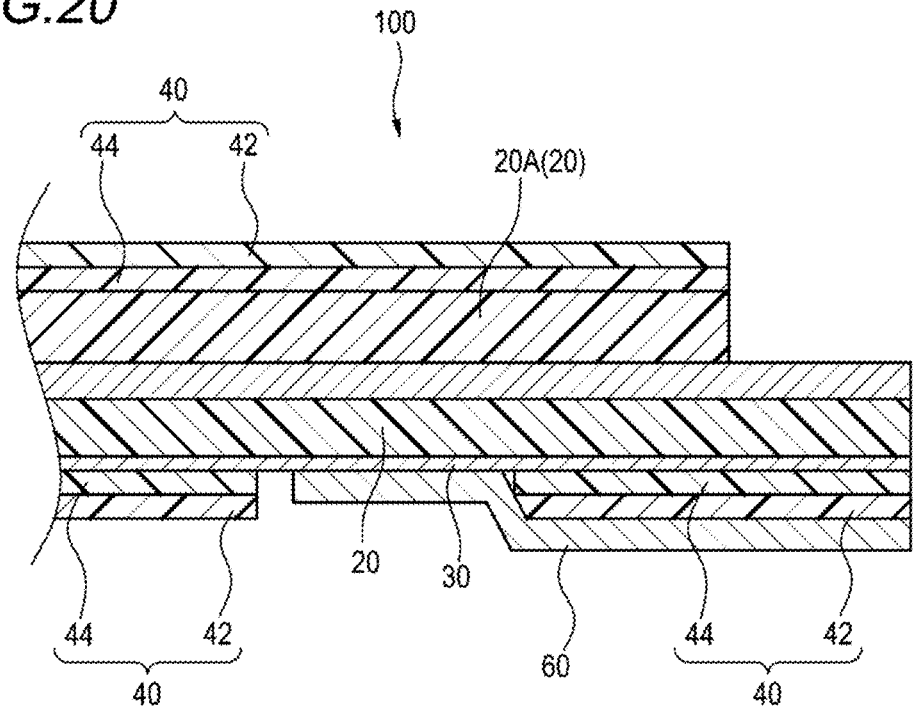
FIG. 20 is a longitudinal sectional view showing an end portion of the flat cable shown in FIG. 19 in a length direction.

FIG. 19 is a cross-sectional view showing a flat cable 100 according to the second embodiment, and FIG. 20 is a longitudinal sectional view showing an end portion of the flat cable 100 in the length direction. In the flat cable 100, the description of the same configuration as the flat cable 1 of the first embodiment is omitted. Further, in FIGS. 19 and 20, illustration of the anchor coat layers 35 and 46 is omitted for simplification of the illustration.

As shown in FIG. 19, in the flat cable 100 of the second embodiment, the shield layer 30 intervenes only between one resin insulating layer 20 of the pair of resin insulating layers 20 and one resin film 40 of the pair of resin films 40. That is, in the flat cable 100, the shield layer 30 is disposed only on one side of the parallel surface of the flat conductors 10. Similarly to the flat cable 1 of the first embodiment, in the flat cable 100, the end portions of the shield layer 30 are also on the outer side with respect to the outermost flat conductor 10 by a half or more of the width dimension of the flat conductor.

In the flat cable 100 shown in FIG. 19, the width dimension of the pair of resin insulating layers 20 substantially coincide with the width dimension of the pair of resin films 40, and end portions on both sides of the shield layer 30 in the conductor parallel direction are covered with the resin insulating layer 20. Therefore, similarly to the first embodiment, the end portions on both sides of the shield layer 30 are not exposed, so that a defect such as the occurrence of a spark at the time of withstand voltage test after cable formation can be prevented.

In the flat cable 100 of the second embodiment shown in FIG. 19, the width dimension of the pair of resin insulating layers 20 substantially coincide with the width dimension of the pair of resin films 40, but the present invention is not limited thereto. For example, as in the flat cable 1 of the first embodiment shown in FIG. 1, the width dimension of the resin films 40 is larger than the width dimension of the resin insulating layers 20, and end portions on both sides of the pair of resin films 40 are bonded to each other so as to cover the end portions on both sides of the resin insulating layers 20 and the shield layers 30.

As shown in FIG. 20, a grounding member 60 is attached to the flat cable 100 at an end portion in the cable length direction. On a surface (upper surface in FIG. 20) of the flat cable 100 at a side where the shield layer 30 is not provided, the resin insulating layer 20 and the resin film 40 are removed by a predetermined length to expose the flat conductor 10. On the other hand, on a surface (lower surface in FIG. 20) at a side where the shield layer 30 is provided, the resin film 40 is removed by a predetermined length at a portion which is on an inner side of the end portion by a predetermined distance, so that the shield layer 30 is exposed from the resin film 40. One end side of the grounding member 60 is in contact with the exposed portion of the shield layer 30. Further, the other end side of the grounding member 60 is in contact with the resin film 40 on the end portion in the cable length direction.

In the configuration of the flat cable 100 in which the shield layer 30 is provided only on one surface of the parallel surface of the flat conductors 10, a resin insulating layer 20A of the pair of resin insulating layers 20 on which the shield layer 30 is not provided may be made of a resin material containing a flame retardant material (for example, phosphorus-based flame retardants and nitrogen-based flame retardants). This is because that even when the flame retardant is contained in the resin insulating layer 20A on the side where the shield layer 30 is not provided, the transmission characteristics of the flat cable 100 are not greatly affected. As described above, the resin insulating layer 20 on the shield layer 30 side is made of a resin material containing no flame retardant as in the first embodiment, and on the other hand, the resin insulating layer 20A is made of a resin material containing the flame retardant (as in the related art), so that the flame retardance of the flat cable 100 can be further enhanced while the transmission characteristics are not reduced. For the side where the shield layer 30 is provided, the flame retardance is secured by the flame retardant insulating layer 44 of the resin film 40.

Figure 21:
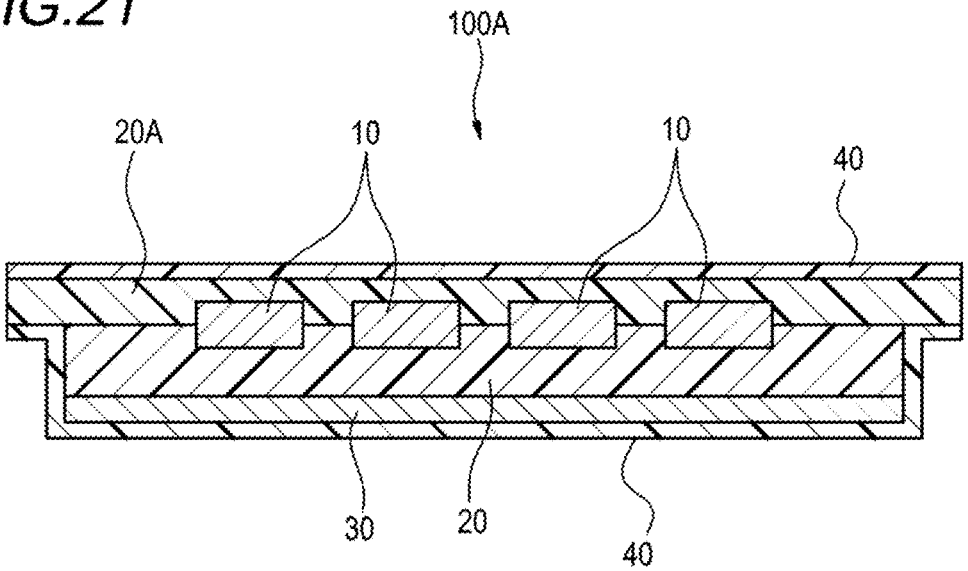
FIG. 21 is a cross-sectional view of a flat cable according to a seventh modification.

FIG. 21 is a cross-sectional view of a flat cable 100A according to a seventh modification. In the drawings after FIG. 21, the resin film 40 collectively represents the base layer 42, the flame retardant insulating layer 44 and the anchor coat layer 46 as one layer (reference numeral 40) for simplification of the illustration.

In the second embodiment described above, the shield layer 30 is configured such that the width dimension in the conductor parallel direction is smaller than that of the resin insulating layer 20, and the end portions on both sides are covered with the resin insulating layer 20, but the present invention is not limited thereto. As in the flat cable 100A shown in FIG. 21, the width dimension of the resin insulating layer 20 on the side where the shield layer 30 is provided may substantially coincide with the width dimension of the shield layer 30, and the resin film 40 covering the outer surface of the shield layer 30 also covers end portions on both sides of the shield layer 30 and end portions on both sides of the resin insulating layer 20 on the side covered with the shield layer 30. As described above, the side end of the shield layer 30 and the side end of the resin insulating layer 20 on the shield layer 30 side are covered with the resin film 40 containing a flame retardant, so that the flame retardance of the flat cable 100A is enhanced. The end portions on both sides of the shield layer 30 are not exposed, so that a defect (such as the occurrence of a spark) at the time of withstand voltage test after cable formation can be prevented.

Figure 22:
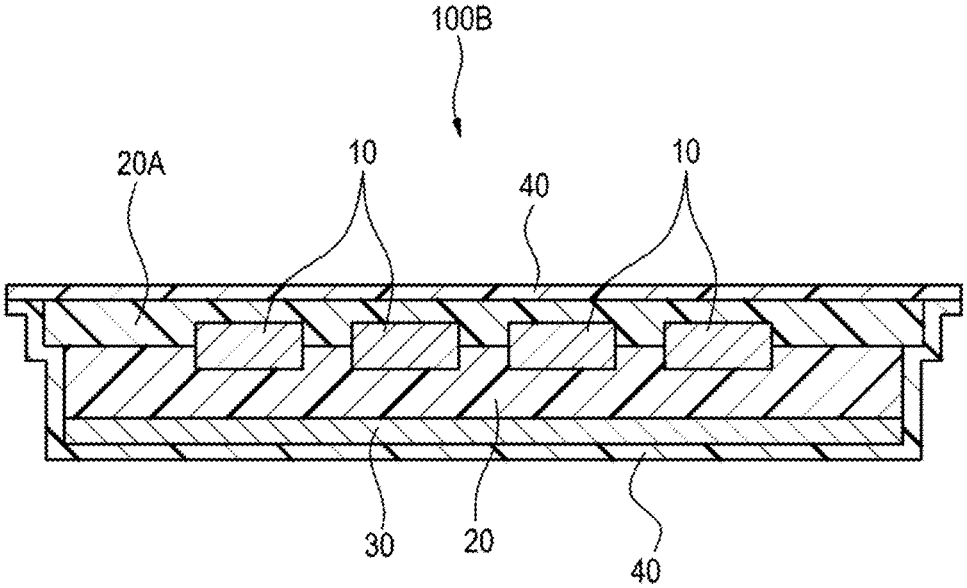
FIG. 22 is a cross-sectional view of a flat cable according to another example of the seventh modification.

In FIG. 21, the end portions on both sides of the resin insulating layer 20A on the side where the shield layer 30 is not provided are exposed, but the present invention is not limited thereto. As the configuration of a flat cable 100B shown in FIG. 22, the resin film 40 covering the shield layer 30 and the resin insulating layer 20 on the side where the shield layer 30 is provided may cover the end portions on both sides of a resin insulating layer 20A on the other side. Accordingly, the flame retardance can be improved, and end portions on both sides (end portions in the width direction, which is the conductor parallel direction) of the resin film 40 can be prevented from being peeled off.

Figure 23:
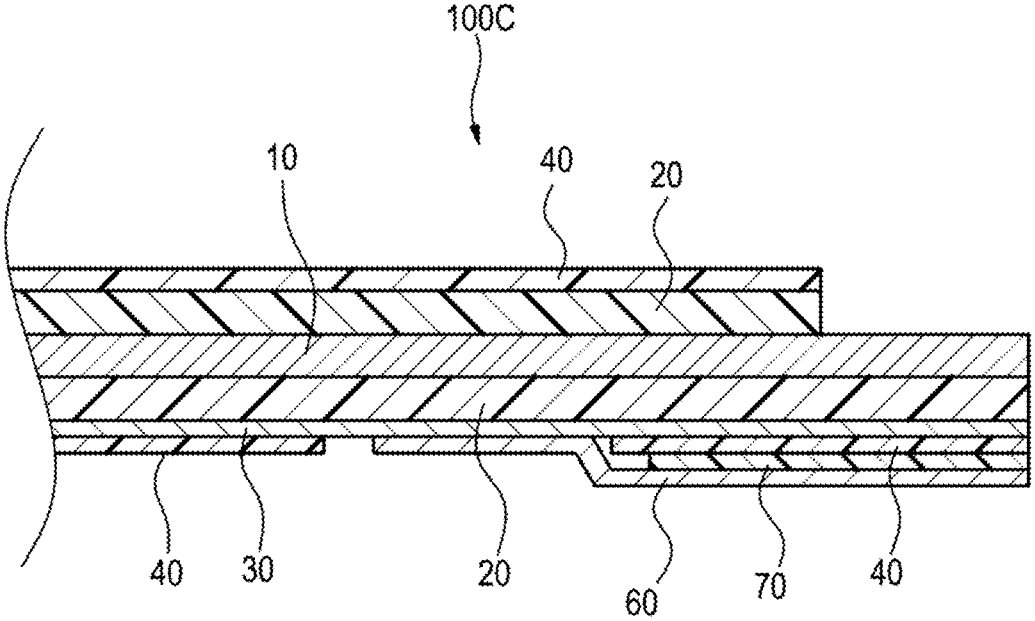
FIG. 23 is a longitudinal sectional view showing an end portion in a length direction of a flat cable according to an eighth modification.

FIG. 23 is a longitudinal sectional view showing an end portion in the length direction of a flat cable 100C according to an eighth modification.

As shown in FIG. 23, on a surface (upper surface in FIG. 23) of the flat cable 100C at a side where the shield layer 30 is not provided, the resin insulating layer 20 and the resin film 40 are removed by a predetermined length to expose the flat conductor 10. On the other hand, on a surface (lower surface in FIG. 23) at a side where the shield layer 30 is provided, the resin film 40 is removed, by laser irradiation, for example, by a predetermined length at a portion which is on an inner side of the end portion by a predetermined distance, so that the shield layer 30 is exposed. Instead of the laser irradiation, a part of the shield layer 30 may be exposed by bonding the resin film 40 to the shield layer 30 at intervals by a laminating roller. One end side of the grounding member 60 is in contact with the exposed portion of the shield layer 30. The other end side of the grounding member 60 is attached to the resin film 40 on the end portion in the cable length direction via a resin film 70. That is, the resin film 70 different from the resin film 40 is intervened between the resin film 40 and the grounding member 60 on the end portion in the cable length direction. Similar to the resin film 50 in the fifth modification, the resin film 70 may be made of the same resin material as the resin film 40 (for example, polyethylene-terephthalate), and may also be made of a material different from the resin film 40. As described above, the resin film 70 is attached between the resin film 40 and the grounding member 60 so as to correspond to the exposed portion of the flat conductor 10, so that exposed portion of the flat conductor 10 and the grounding member 60 can be reinforced.

Figure 24:
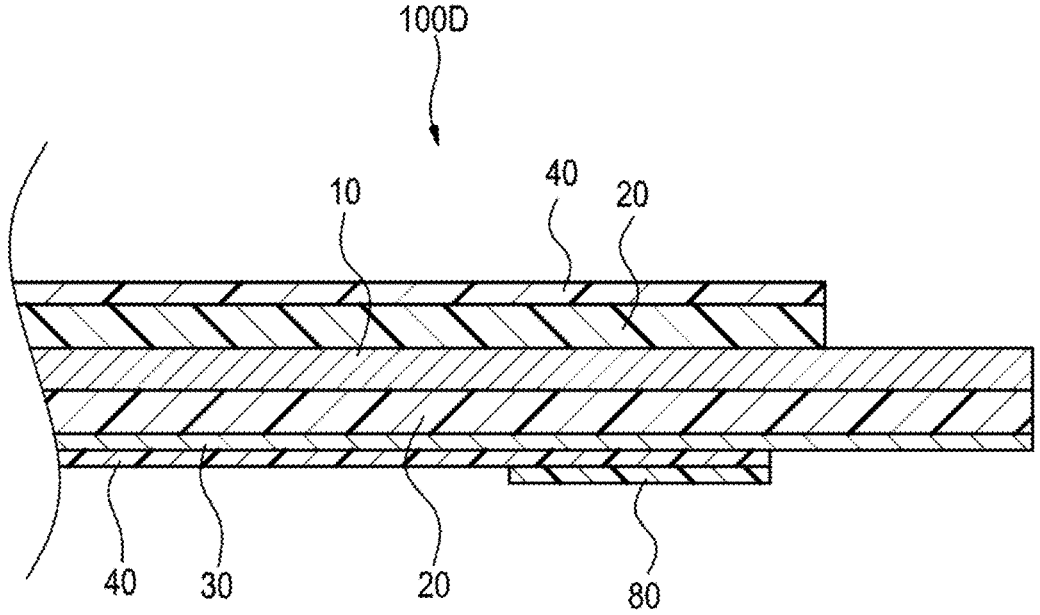
FIG. 24 is a longitudinal sectional view showing an end portion in a length direction of a flat cable according to a ninth modification.

FIG. 24 is a longitudinal sectional view showing an end portion in the length direction of a flat cable 100D according to a ninth modification.

As shown in FIG. 24, at the end portion of the flat cable 100D in the length direction, on a surface (upper surface in FIG. 24) at the side where the shield layer 30 is not provided, the resin insulating layer 20 and the resin film 40 are removed by a predetermined length to expose the flat conductor 10. On the other hand, on a surface (lower surface in FIG. 24) at a side where the shield layer 30 is provided, the resin film 20 is removed by a predetermined length to expose the shield layer 30. Then, on this surface, a resin film 80 for reinforcement is attached to the end portion of the resin film 40. The resin film 80 may be made of the same resin material as the resin film 40 (for example, polyethylene terephthalate), and may also be made of a material different from the resin film 40 as long as the flat conductor 10 can be reinforced. In the ninth modification, grounding is performed by the exposed shield layer 30 without using the grounding member 60 of the sixth modification. That is, according to the flat cable 100D, it is possible to realize a reduction in production cost and a reduction in thickness since the grounding member 60 is not required.

Figure 25:
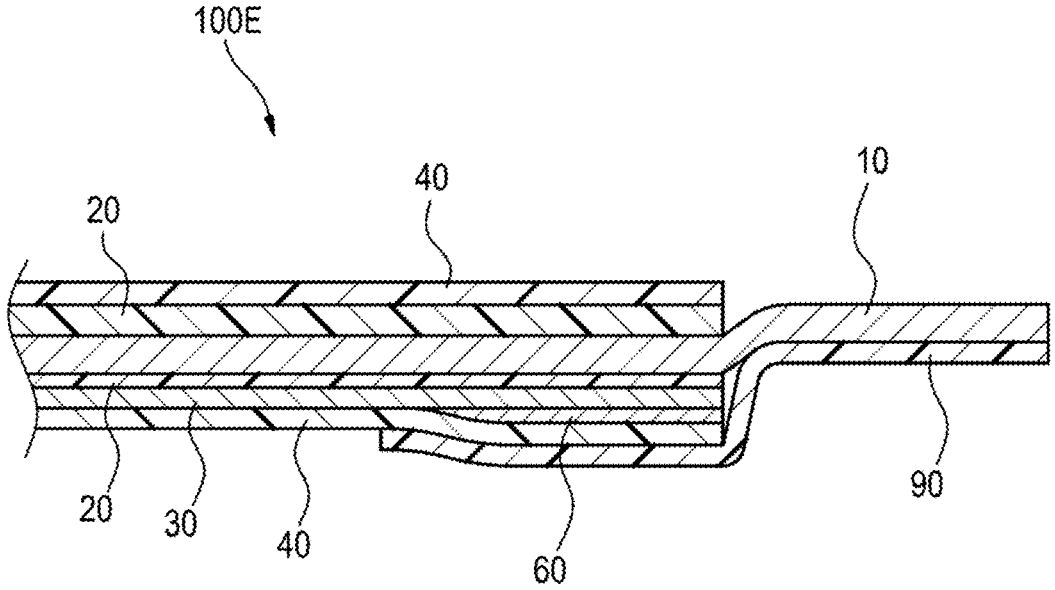
FIG. 25 is a longitudinal sectional view showing an end portion in a length direction of a flat cable according to a tenth modification.

FIG. 25 is a longitudinal sectional view showing an end portion in the length direction of a flat cable 100E according to a tenth modification.

In the flat cable 100E shown in FIG. 25, at the end portion in the cable length direction, the pair of resin insulating layers 20, the shield layer 30 provided on the outer surface of one resin insulating layer 20, and the pair of resin films 40 is removed by a predetermined length to expose the flat conductor 10. The exposed portion of the flat conductor 10 is bent upward in FIG. 25. Further, the grounding member 60 electrically connected to the shield layer 30 is provided between the shield layer 30 and the resin film 40 at the end portion in the cable length direction. A resin film 90 (an example of a third resin film) covers the outer surface of the resin film 40 at a position corresponding to an overlap portion of the shield layer 30 and the grounding member 60. The resin film 90 also covers one surface (lower surface in FIG. 25) of the flat conductor 10 exposed from the resin insulating layer 20 and the resin film 40. That is, the resin film 90 is attached so as to extend from one surface side of the exposed portion of the flat conductor 10 to a portion where the grounding member 60 of the resin film 40 is provided. The resin film 90 may be made of the same resin material as the resin film 40 (for example, polyethylene terephthalate), and may also be made of a material different from the resin film 40. The grounding member 60 protrudes from the resin film 40 in a direction perpendicular to the paper surface in FIG. 25, and can be electrically connected to a ground terminal of a connecting member such as a connector at that portion. According to this configuration, at least a part of the grounding member 60 is covered with the resin film 40, so that the bonding of the grounding member 60 to the shield layer 30 can be strengthened. Further, the flat conductor 10 protruding from the resin film 40 can be reinforced by the resin film 90.

Figure 26:
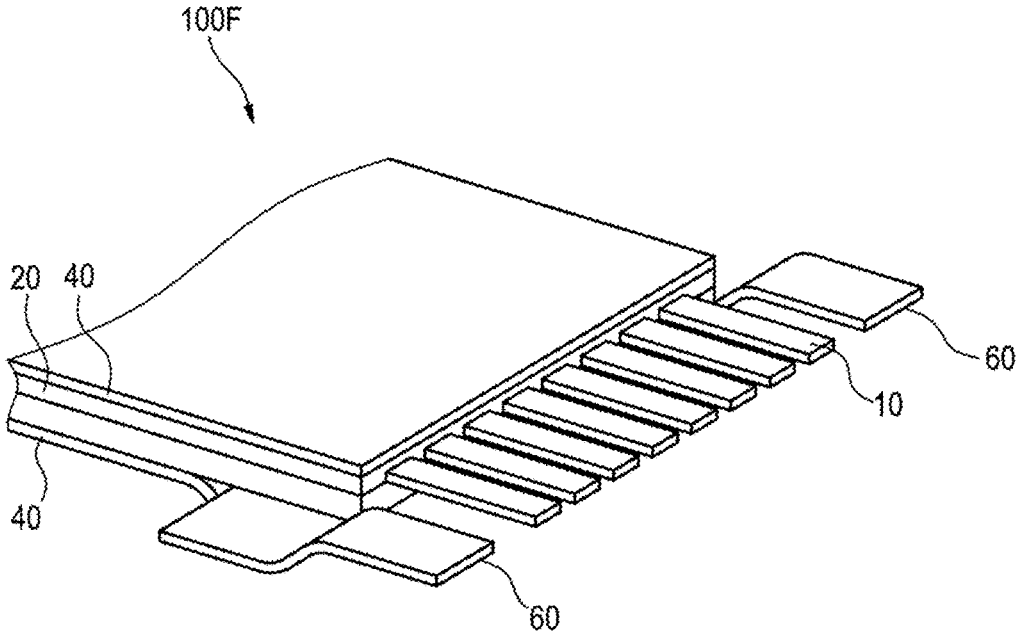
FIG. 26 is a perspective view showing an end portion in a length direction of a flat cable according to another example of the tenth modification.

As in a flat cable 100F shown in FIG. 26, the grounding member 60 may be configured such that an end portion thereof protrudes from the resin film 40, and the protruding portion is bent so as to have the same height as the plurality of flat conductors 10 in the direction orthogonal to the conductor parallel direction (hereinafter, referred to as cable thickness direction), and to be arranged in parallel with the flat conductors 10. Therefore, impedance can be matched by adjusting the thickness balance of the grounding member 60 and the insulating material.

Although the present invention is described in detail with reference to a particular embodiment, it is apparent to those skilled in the art that various changes and modifications can be made without departing from the spirit and scope of the present invention. The numbers, positions, shapes or the like of components described above are not limited to the above embodiment, and can be changed to suitable numbers, positions, shapes or the like during carrying out the present invention.

In the above embodiments, the pair of resin insulating layers 20 are used as an insulator that integrates the plurality of flat conductors 10, but the present invention is not limited thereto. For example, the insulator may be configured by extruding and covering a resin around a plurality of flat conductors 10 arranged in parallel. The configuration is suitable for mass production of similar flat cables (long cable).

REFERENCE SIGNS LIST

1 flat cable
10 flat conductor
20 resin insulating layer
30 shield layer
35 anchor coat layer
40 resin film (example of first resin film)
42 base layer
44 flame retardant insulating layer
46 anchor coat layer
50 resin film (example of third resin film)
60 grounding member
70, 80 resin film
90 resin film (example of second resin film)
R1, R2 laminate roller

The invention claimed is:

1. A shielded flat cable comprising:
a plurality of conductors arranged in parallel;
a resin insulating layer sandwiching the plurality of conductors from both sides of a parallel surface of the plurality of conductors, and covering portions other than end portions of the plurality of conductors in a length direction;
a shield layer disposed at an outer surface of the resin insulating layer via an anchor coat layer; and
a first resin film with an adhesive covering an outer surface of the shield layer,
wherein the resin insulating layer does not contain a flame retardant,
wherein a dielectric loss tangent of the resin insulating layer is 0.001 or less at 10 GHz, and
wherein the adhesive or the first resin film is made of a flame retardant material.

2. The shielded flat cable according to claim 1,
wherein in a parallel direction of the plurality of conductors, an end portion of the shield layer is on an outer side with respect to an end portion of the outermost conductor among the plurality of conductors by a half or more of a width dimension of the outermost conductor, and
wherein the end portion in the parallel direction of the shield layer is covered with the resin insulating layer.

3. The shielded flat cable according to claim 1,
wherein in a parallel direction of the plurality of conductors, an end portion of the shield layer is on an outer side with respect to an end portion of the outermost conductor among the plurality of conductors by a half or more of a width dimension of the outermost conductor, and
wherein the end portion in the parallel direction of the shield layer is covered with the first resin film.

4. The shielded flat cable according to claim 1, further comprising:
a grounding member attached to an end portion in the length direction,
wherein a portion of the shield layer is exposed from the first resin film, and the grounding member is in contact with the shield layer at the exposed portion.

5. The shielded flat cable according to claim 1,
wherein the shield layer is exposed at an end portion in the length direction.

6. The shielded flat cable according to claim 1,
wherein at an end portion in the length direction, each of the plurality of conductors is completely exposed from the resin insulating layers.

7. The shielded flat cable according to claim 6, further comprising:
a grounding member superimposed on and in contact with the outer surface of the shield layer at the end portion in the length direction,
wherein the first resin film covers the shield layer and the grounding member.

8. The shielded flat cable according to claim 7,
wherein a portion of the grounding member protrudes from the first resin film, and the protruding portion is arranged in parallel with the plurality of conductors.

9. The shielded flat cable according to claim 7, further comprising:
a second resin film covering the first resin film,
wherein the second resin film is bonded to at least a part of exposed portions of the plurality of conductors.

10. The shielded flat cable according to claim 6, further comprising:
a third resin film bonded to at least a part of exposed portions of the plurality of conductors,
wherein the shield layer is bonded to an outer surface of the third resin film.

11. The shielded flat cable according to claim 10,
wherein the third resin film is bonded to the resin insulating layer at the end portion in the length direction.

12. The shielded flat cable according to claim 6, further comprising:

a third resin film bonded to exposed portions of the plurality of conductors and the shield layer at the end portion in the length direction; and a grounding member superimposed on and in contact with the outer surface of the shield layer and bonded to the third resin film.

13. The shielded flat cable according to claim 1, wherein at least a part of end portions of the resin insulating layers in the parallel direction of the conductors is covered with the first resin film.

14. The shielded flat cable according to claim 13, wherein an entire surface of the end portions of the resin insulating layers is covered with the first resin film.

15. A shielded flat cable comprising:

a plurality of conductors arranged in parallel;

a resin insulating layer sandwiching the plurality of conductors from both sides of a parallel surface of the plurality of conductors, and covering portions other than end portions of the plurality of conductors in a length direction;

a shield layer disposed at an outer surface of the resin insulating layer via an anchor coat layer;

a first resin film with an adhesive covering an outer surface of the shield layer, and a grounding member superimposed on and in contact with the outer surface of the shield layer at the end portion in the length direction, wherein a dielectric loss tangent of the resin insulating layer is 0.001 or less at 10 GHz, wherein the adhesive or the first resin film is made of a flame retardant material, wherein at an end portion in the length direction, each of the plurality of conductors is completely exposed from the resin insulating layer, and wherein the first resin film covers the shield layer and the grounding member.

16. A shielded flat cable comprising:

a plurality of conductors arranged in parallel;

a resin insulating layer sandwiching the plurality of conductors from both sides of a parallel surface of the plurality of conductors, and covering portions other than end portions of the plurality of conductors in a length direction;

a shield layer disposed at an outer surface of the resin insulating layer via an anchor coat layer;

a first resin film with an adhesive covering an outer surface of the shield layer; and a third resin film bonded to at least a part of exposed portions of the plurality of conductors, wherein a dielectric loss tangent of the resin insulating layer is 0.001 or less at 10 GHz, wherein the adhesive or the first resin film is made of a flame retardant material, wherein at an end portion in the length direction, each of the plurality of conductors is completely exposed from the resin insulating layer, and wherein the shield layer is bonded to an outer surface or an inner surface of the third resin film.

* * * * *